US007800271B2

(12) United States Patent
Komuro et al.

(10) Patent No.: US 7,800,271 B2
(45) Date of Patent: Sep. 21, 2010

(54) SINTERED MAGNET AND ROTATING MACHINE EQUIPPED WITH THE SAME

(75) Inventors: Matahiro Komuro, Hitachi (JP); Yuichi Satsu, Hitachi (JP); Yutaka Matsunobu, Mito (JP); Takashi Yasuhara, Yotsukaido (JP)

(73) Assignee: Hitachi, Ltd., Tokyo (JP)

( * ) Notice: Subject to any disclaimer, the term of this patent is extended or adjusted under 35 U.S.C. 154(b) by 107 days.

(21) Appl. No.: 12/361,238

(22) Filed: Jan. 28, 2009

(65) Prior Publication Data

US 2009/0224615 A1 Sep. 10, 2009

(30) Foreign Application Priority Data

Jan. 31, 2008 (JP) ..... 2008-020040

(51) Int. Cl.
*H02K 1/27* (2006.01)
*H01F 1/057* (2006.01)
*B05D 5/00* (2006.01)

(52) U.S. Cl. ..... 310/156.53; 310/156.43; 310/156.56; 148/302; 252/62.55; 427/127

(58) Field of Classification Search ..... 310/156.01, 310/156.43, 156.53, 156.56–156.57; 148/100, 148/101, 105, 120, 300, 301, 302; 252/62.55, 252/62.59, 62.63, 62.64; 427/127; 428/328, 428/332

See application file for complete search history.

(56) References Cited

U.S. PATENT DOCUMENTS 4,981,532 A * 1/1991 Takeshita et al. ..... 148/302
7,485,193 B2 * 2/2009 Hirota et al. ..... 148/302
2005/0081959 A1 4/2005 Kim et al.
2006/0022175 A1 * 2/2006 Komuro et al. ..... 252/500

(Continued)

FOREIGN PATENT DOCUMENTS

EP 1 705 668 A2 9/2006

(Continued)

OTHER PUBLICATIONS

Hajime Nakamura et al., Magnetic Properties of Extremely Small Nd-Fe-B Sintered Magnets, IEEE Transactions on Magnetics, vol. 41, No. 10, Oct. 2005, pp. 3844-3846.

(Continued)

*Primary Examiner*—Tran N Nguyen
(74) *Attorney, Agent, or Firm*—Crowell & Moring LLP

(57) ABSTRACT

The sintered magnet and the rotating machine equipped with the same are disclosed. The sintered magnet includes crystal grains of a ferromagnetic material consisting mainly of iron, and a fluoride compound or oxyfluoride compound layer containing at least one element selected from an alkali metal element, an alkali earth metal element, and a rare earth element. The layer is formed inside some of the crystal grains or in a part of a grain boundary part. An oxyfluoride compound or fluoride compound layer containing carbon in a stratified form is formed on an outermost surface of the crystal grains. The fluoride compound or oxyfluoride compound layer has a concentration gradient of carbon, contains at least one light rare earth element and at least one heavy rare earth element. The heavy rare earth element has a concentration lower than that of the light rare earth element.

14 Claims, 11 Drawing Sheets

U.S. PATENT DOCUMENTS

| | | | | |
|---|---|---|---|---|
| 2006/0191601 | A1* | 8/2006 | Komuro et al. | 148/302 |
| 2006/0213582 | A1* | 9/2006 | Nakamura et al. | 148/302 |
| 2006/0213583 | A1* | 9/2006 | Nakamura et al. | 148/302 |
| 2006/0213584 | A1* | 9/2006 | Nakamura et al. | 148/302 |
| 2006/0213585 | A1* | 9/2006 | Nakamura et al. | 148/302 |
| 2006/0222848 | A1 | 10/2006 | Satsu et al. | |
| 2007/0071979 | A1 | 3/2007 | Komuro et al. | |
| 2007/0144615 | A1* | 6/2007 | Komuro et al. | 148/105 |
| 2007/0151632 | A1 | 7/2007 | Komuro et al. | |
| 2008/0247898 | A1* | 10/2008 | Nakamura et al. | 419/9 |

FOREIGN PATENT DOCUMENTS

| | | | |
|---|---|---|---|
| JP | 2003-282312 | A | 10/2003 |
| JP | 2007-194599 | A | 8/2007 |

OTHER PUBLICATIONS

Japanese Office Action dated Feb. 2, 2010 (five (5) pages).
The Partial European Search Report dated May 26, 2009 (Five (5) pages).
European Search Report dated Oct. 2, 2009 (Fourteen (14) pages).

* cited by examiner

SINTERED MAGNET AND ROTATING MACHINE EQUIPPED WITH THE SAME

INCORPORATION BY REFERENCE

The disclosure of the following priority application is herein incorporated by reference: Japanese Patent Application No. 2008-020040 filed Jan. 31, 2008.

BACKGROUND OF THE INVENTION

1. Field of the Invention

The present invention relates to a magnet that contains decreased amounts of heavy rare earth metals and exhibits high energy product or high heat resistance, to a method for producing the same, and to a rotating machine equipped with such a magnet.

2. Description of Related Art

A conventional rare earth sintered magnet containing a fluoride compound or an oxyfluoride compound is disclosed in Patent Literature 1. In the conventional technology, the fluoride compound used for processing is a mixture of a powdery compound or powder of the compound and a solvent, and it is difficult to efficiently form a phase containing fluorine along surfaces of magnetic particles. In the above-mentioned conventional method, the fluoride compound used for the processing is in point contact with the surface of the magnetic particles, and it is difficult for the phase containing fluorine to come in surface contact with the magnetic particles. Therefore, there are required a large amount of the processing material and heat treatment at high temperatures.

On the other hand, Patent Literature 2 discloses a mixture of micro-structured powder of rare earth fluoride compound (1 to 20 μm) and NdFeB powder. However, there is disclosed no example of growth of the micro-structured powder of rare earth fluoride compound in the grain of the magnet in a state of discrete plates.

Non-Patent Literature 3 discloses a magnet that includes a micro sintered magnet coated on the surface thereof with micro particles (1 to 5 μm) of $DyF_3$ or $TbF_3$. Although it is described in the above-mentioned literature to the effect that the fluoride compound is applied by a treatment other than the treatment with a solution of the fluoride compound and that Dy and F are absorbed by the sintered magnet to form NdOF and Nd oxide, there is in the Non-Patent Literature 1 no teaching on the relationship between concentration gradients of carbon, heavy rare earth metals, light rare earth metals in the oxyfluoride compound and direction of anisotropy.

[Patent Literature 1] JP, 2003-282312, A

[Patent Literature 2] U.S. patent US2005/0081959A1

[Non-Patent Literature 1] Page 3846 from IEEE TRANSACTIONS ON MAGNETICS and VOL. 41 No. 10 (2005) Page 3844

SUMMARY OF THE INVENTION

Conventionally, pulverized powder of a fluoride compound or the like has been used as a material in order to form a stack of a phase that contains fluorine on NdFeB magnetic particles. There has been no description of a state of a low viscosity, transparent solution of the fluoride compound or the like. Use of the pulverized powder of the fluoride compound or the like results in a high heat treatment temperature required for diffusion of the fluoride compound or the like. This makes it difficult to improve magnetic properties of the magnetic particles that tend to be deteriorated at temperatures lower than temperatures at which sintered magnets are deteriorated or to decrease the concentration of the rare earth element in the magnetic particles. Therefore, the conventional technique involves high heat treatment temperature and uses a large amount of the fluoride compound necessary for diffusion. This makes it difficult to apply the conventional technique to magnets having a thickness above 10 mm.

It is an object of the present invention to provide a sintered magnet and a rotating machine equipped with the same that can be easily produced at low concentrations of rare earth elements and at low temperatures.

According to a first aspect of the present invention, use is made of a rotating machine comprising a sintered magnet, wherein the sintered magnet includes crystal grains of a ferromagnetic material consisting mainly of iron, and a layer of a fluoride compound or a layer of an oxyfluoride compound, containing at least one element selected from the group consisting of an alkali metal element, an alkali earth metal element, and a rare earth element, the layer of the fluoride compound or the layer of the oxyfluoride compound being formed inside some of the crystal grains or in a part of a grain boundary part, an oxyfluoride compound or fluoride compound containing carbon in a stratified form is formed on an outermost surface of the crystal grains, the layer of fluoride compound or oxyfluoride compound has a concentration gradient of carbon, the layer of oxyfluoride compound contains at least one light rare earth element and at least one heavy rare earth element, and the at least one heavy rare earth element has a concentration lower than that of the light rare earth element.

It is preferred that the fluoride compound, the oxyfluoride compound or the oxyfluoride compound containing carbon in the sintered magnet is formed by impregnation of a solution that is transmissive to light containing the fluoride compound, the oxyfluoride compound or the oxyfluoride compound containing carbon.

According to a second aspect of the present invention, use is made of a sintered magnet comprises crystal grains of a ferromagnetic material consisting mainly of iron and a rare earth element, and a layer of a fluoride compound or a layer of an oxyfluoride compound, containing at least one element selected from the group consisting of an alkali metal element, an alkali earth metal element, and a rare earth element. The layer of the oxyfluoride compound or the layer of the fluoride compound is formed inside some of the crystal grains or in a portion of grain boundary part of the crystal grains. The layer of the oxyfluoride compound or the layer of the fluoride compound contains carbon. The oxyfluoride compound or the fluoride compound that are present on the outermost surface of the layer of the oxyfluoride compound or the layer of the fluoride compound, respectively, has a mean crystal particle size larger than that of the oxyfluoride compound or the fluoride compound in the inside of the crystal particles.

It is preferred that the layer of the oxyfluoride compound or the layer of the fluoride compound has a mean volume that is different between a direction parallel to a direction of anisotropy and a direction perpendicular to the direction of anisotropy.

It is also preferred that the layer of the oxyfluoride compound or the layer of the fluoride compound has a difference in at least one of concentration, film thickness and continuity thereof between a direction parallel to a direction of anisotropy and a direction perpendicular to the direction of anisotropy.

Moreover, the outermost surface of the sintered magnet may be covered with an oxyfluoride compound or a fluoride compound having a fluorine concentration higher than an oxide concentration; and an interface between a main phase of the sintered magnet and the oxyfluoride compound may have unevenness of 10 nm or larger and 10 μm or smaller.

According to a third aspect of the present invention, it is preferred that use is made of a rotating machine that comprises: a stator having an iron core and a stator winding wire; a rotor disposed rotatably with a space from the stator; the rotor having formed therein a plurality of slots, each of the slots having embedded therein at least one permanent magnet; each of the permanent magnets constituting a field pole. The permanent magnet includes crystal grains of a ferromagnetic material consisting mainly of iron, and a layer of a fluoride compound or a layer of an oxyfluoride compound, containing at least one element selected from the group consisting of an alkali metal element, an alkali earth metal element, and a rare earth element, the layer of the fluoride compound or the layer of the oxyfluoride compound being formed inside some of the crystal grains or in a part of a grain boundary part, an oxyfluoride compound or fluoride compound containing carbon in a stratified form is formed on an outermost surface of the crystal grains, the layer of oxyfluoride compound contains at least one light rare earth element and at least one heavy rare earth element, the layer of oxyfluoride compound contains at least one light rare earth element and at least one heavy rare earth element, and the at least one heavy rare earth element has a concentration lower than that of the light rare earth element.

The present invention can provide the sintered magnet that the diffusion of fluorine or the rare earth element is possible by the low temperature and the rotating machine that used it.

DESCRIPTION OF PREFERRED EMBODIMENTS

Figure 1:
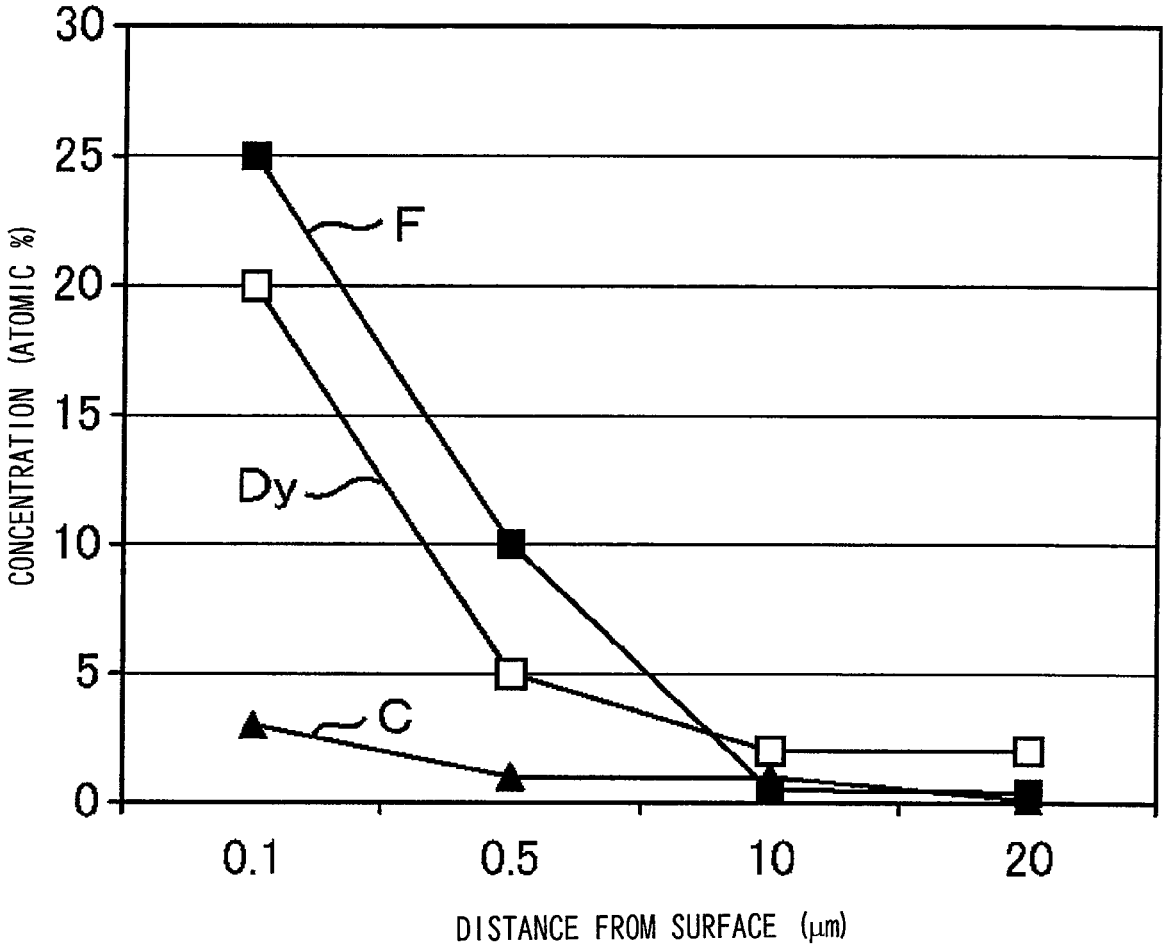
FIG. 1 is a graph that shows one example of the concentration distributions of F, Dy, and C on cross-section of the sintered magnet according to an embodiment of the present invention.

Embodiments of the present invention will be described below with reference to the drawings.

In an embodiment of the present invention, a solution of a fluoride compound is used, which solution does not contain pulverized powder and is optically transmissive. Such a solution is impregnated into a low density molded body having voids and then the impregnated low density molded body is sintered. When a sintered magnet that includes $Nd_2Fe_{14}B$ as a main phase are to be fabricated, magnetic particles are adjusted for their particle size distribution and then premolded in a magnetic field. The obtained premolded body has voids or spaces between the adjacent magnetic particles, and hence it is possible to apply a fluoride compound solution into the central part of the premolded body by impregnating the fluoride compound solution into the voids. The fluorine compound solution preferably is a highly transparent solution, a solution that is optically transmissive or a low viscosity solution, and use of such a solution enables the fluoride compound solution to enter minute spaces between adjacent magnetic particles. The impregnation can be carried out by contacting a part of the preformed body to the fluoride compound solution. This causes the fluoride compound solution to be coated over an interface between the fluoride compound solution and the premolded body touching the solution. If there are gaps or spaces within the range of 1 nm to 1 mm in the surface on which the fluoride compound solution is coated, the fluoride compound solution is impregnated along the surface of magnetic particles surrounding the voids or spaces. The direction of the impregnation is a direction of a continuous space of the preformed body, and depends on the preforming condition and the shape of the magnetic particles. There is observed a difference in concentration of some of elements that constitute the fluoride compound after the sintering between a surface that contacts the fluoride compound solution to be impregnated and a surface near a surface that does not contact the fluoride compound solution since the application quantity of the solution is different therebetween. On average, there is observed a difference in concentration distribution of the fluoride compound in a plane perpendicular to the contact surface of the solution. Therefore, when fabricating a premolded body by orienting it in a magnetic field, impregnation of the fluoride compound solution through a surface will lead to different results depending on whether the surface is parallel to or perpendicular to the direction of anisotropy of the premolded body, more particularly, there will be differences in concentration of the fluoride compound, thickness of the film, continuity of the film, and soon between, the contact surface that the impregnation solution contacts, and a non-contact surface that is parallel to the contact surface and perpendicular surface. This is because the impregnation proceeds from the contact surface that the impregnation solution contacts and along the wall surface or surface of the continuous gap or space. This also depends on the distribution of continuous space, so that if there is a distribution of continuous space in the premolded body to be rendered anisotropic, there will be observed differences in concentration, structure, continuity, and thickness of grain boundary phase of the fluoride compound after the sintering. The fluoride compound solution is a solution of a fluoride compound that contains at least one of alkali metal elements, alkaline earth metal elements, or rare earth elements or a fluoride oxide compound that partially contains oxygen. The impregnation treatment is possible at room temperature. The impregnated solution was heat treated at 200° C. to 400° C. to remove the solvent and further heat treatment at 500° C. to 800° C. results in diffusion of oxygen, rare earth elements and elements that constitute the fluorine compound between the fluorine compound and the magnetic particles as well as grain boundaries. The magnetic particles include oxygen at a concentration of 10 to 5,000 ppm. Other impurity elements include light elements such as H, C, P, Si, and Al. The oxygen included in the magnetic particles exists in the forms of not only rare earth oxides and oxides of light elements such as Si and Al but also an oxygen-containing phase that has a composition that is deviated from the stoichiometric composition in a parent phase or matrix. Such an oxygen-containing phase reduces the magnetization intensity of the magnetic particles and affects the shape of the magnetization curve. Specifically, this leads to reductions in the remanent magnetic flux density, the anisotropic magnetic field, the squareness of a magnetization curve, and the coercive force; increases in the irreversible demagnetization ratio, and thermal demagnetization; a change in the magnetization property; deterioration in corrosion; and a reduction in mechanical properties, and so on, thus reducing the reliability of the magnet. Since oxygen affects many properties as mentioned above, processes for preventing oxygen from remaining in the magnetic particles have been considered. The rare earth fluoride compound that has been impregnated and has grown on the surface of the magnetic particles partly contains the solvent. The magnetic particles are heat treated at a temperature of 400° C. or lower to grow $REF_3$ (where RE represents a rare earth element) on the surface thereof, and then held at 500 to 800° C. under a vacuum of $1\times10^{-3}$ Torr or less. The holding time is 30 minutes under the above-described condition. This heat treatment effects diffusion of iron atoms in the magnetic particles and rare earth elements, and oxygen into the fluorine compound so as to appear in $REF_3$, $REF_2$ or RE (OF), or grain boundaries of these compounds. Use of the above-mentioned treatment solution enables the fluoride compound to be diffused inside the magnetic body at relatively low temperatures within the range of 200° C. to 800° C. The impregnation has the following advantages: 1) the amount of the fluorine compound necessary for processing can be reduced; 2) it can be applied to sintered magnets with a thickness of 10 mm or more; 3) the diffusion temperature of the fluorine compound can be decreased; and 4) the heat treatment for diffusion after the sintering is unnecessary. Due to these features, advantageous effects such as an increase in remanent magnetic flux density, an increase in coercive force, an improvement in squareness of demagnetization curve, an improvement in heat demagnetization characteristics, an improvement in magnetization, an improvement in anisotropy, an improvement in anticorrosion, a reduction in loss, an improvement in mechanical strength, and so on become conspicuous in thick plate magnets. In case of NdFeB magnetic particles, besides Nd, Fe, B, additive elements and impurity elements diffuse into the fluoride compounds at heating temperatures of 200 degrees or higher. The concentration of fluorine in the fluoride compound layer is different at the above-mentioned temperature according to the site, and $REF_2$, $REF_3$ (RE represents a rare earth element) or the oxyfluoride counterpart compounds are discontinuously formed in a stratified or tabular form. In the direction in which the fluoride compound is impregnated, the fluoride compound is formed continuously in a stratified form whereas in a direction perpendicular to the direction of impregnation, the amount of the fluoride compound decreases or the thickness of the layer of the fluorine compound is decreased on average. A driving force of diffusion is a temperature, stress (strain), concentration difference in concentration, defects, etc, and the result of the diffusion can be confirmed by observation of the impregnated surface by means of an electron microscope or the like. By use of a solution not containing pulverized powder of the fluoride compound, the fluorine compound can be formed at the center of the preformed body even at room temperature and the fluoride compound can be diffused at low temperatures. As a result, the amount of the fluorine compound to be used can be reduced. This is effective particularly in the case of NdFeB magnetic particles whose magnetic properties tend to be deteriorated at high temperatures. The NdFeB magnetic powder includes magnetic particles containing a phase having a crystal structure equivalent to that of $Nd_2Fe_{14}B$ in the main phase. The main phase may contain transition metals such as Al, Co, Cu, Ti, etc. A portion of B may be substituted by C. Compounds such as $Fe_3B$ or $Nd_2Fe_{23}B_3$, etc or oxides corresponding to them may be contained in a layer other than the main phase. Since the fluoride compound layer exhibits resistance higher than that of NdFeB magnetic powder at 800° C. or lower, it is possible to increase resistance of the NdFeB sintered magnet by forming the fluoride compound layer so that the loss can be reduced. The fluoride compound layer may contain besides the fluoride compound such impurities that have little influence on magnetic properties and exhibit no ferromagnetism at around room temperature. In order to obtain a high resistance, the fluoride compound may contain fine particles of nitrides or carbides. Sintered magnets that have been fabricated through a process of impregnating such a fluoride compound have a concentration distribution of the fluoride compound and continuity that are anisotropic, and so that they can be fabricated with reduced amounts of heavy rare earth elements. Therefore, the sintered magnets with high energy product can be manufactured, and they can be applied to high torque rotating machines.

First Embodiment

Magnetic powder consisting mainly of $Nd_2Fe_{14}B$ is prepared as an NdFeB series magnetic powder. On the surface of magnetic particles is formed a fluoride compound. When $DyF_3$ is formed on the surface of the magnetic particles, $Dy(CH_3COO)_3$ as a starting material is dissolved in water and HF is added thereto. Addition of HF results in formation of gelatinous $DyF_3.XH_2O$ or $DyF_3.X(CH_3COO)$ (where X is a positive integer). The resultant is centrifuged to remove the solvent to obtain a solution that is optically transmissive. The magnetic particles are charged in a mold and pressed at a load of 1 t/cm2 in a magnetic field of 10 kOe to form a preformed body. Continuous spaces exist in the preformed body. Only the bottom surface of the preformed body is immersed in the solution that is optically transmissive. The bottom surface is a side parallel to the direction of magnetic field. The solution soaks from the bottom surface and the side surface of the preformed body into the voids between adjacent magnetic particles, and the solution that is optically transmissive is spread on the surface of the magnetic powder. Next, the solvent of the solution that is optically transmissive is evaporated, the hydrated water is evaporated by heating, and the magnetic powder is sintered at about 1,100° C. Upon sintering, Dy, C, and F that constitute the fluoride compound diffuse along at the surface and the grain boundary of the magnetic particles, and there occurs mutual diffusion in which Dy, C, and F are exchanged with Nd and Fe that constitutes the magnetic particles. In particular, the diffusion in which Dy is exchanged for Nd progresses near the grain boundary, and a structure in which Dy is segregated along the grain boundary is formed. As a result, it is revealed that the fluoride compound and oxyfluoride compound are formed at a triple point of the grain boundary (grain boundary triple point), which is comprised by $DyF_3$, $DyF_2$, DyOF, etc. Such a sintered magnet exhibited a 40% increase in coercive force, a decrease in residual magnetic flux due to the increase in the coercive force is 2%, and a 10% increase in Hk as compared with the case where no fluoride compound has been used. The sintered magnet impregnated with the fluoride compound has high energy product, so that it can be applied to a rotating machine for use in hybrid cars. The magnetic field necessary for the magnetization of the sintered magnet is 20 kOe in the case where the matrix is of NdFeB series. The sintered magnets are arranged on the outer periphery. The rotor is constituted by an electromagnetic steel sheet or amorphous ring disposed around the outer periphery of a nonmagnetic shaft. By supplying electric current from an inverter to armature coils through a reactor according to the positions of poles of the sintered magnets, the rotating machine is driven to rotate. The rotating machine to which the above-mentioned sintered magnet is applied also includes a device for driving vanes of air conditioning compressors, etc. and includes high speed machines with a number of rotation of 10,000 rpm or higher.

Second Embodiment

Magnetic powder with an average particle diameter of 5 μm consisting mainly of $Nd_2Fe_{14}B$ and containing about 1% boride and a rare earth-rich phase is prepared as an NdFeB series magnetic powder. On the surface of the magnetic particles is formed a fluoride compound. When $DyF_3$ is formed on the surface of the magnetic particles, $Dy(CH_3COO)_3$ as a starting material is dissolved in water and HF is added thereto. Addition of HF results in formation of gelatinous $DyF_3.XH_2O$ or $DyF_3.X(CH_3COO)$ (where X is a positive integer). The resultant is centrifuged to remove the solvent to obtain a solution that is optically transmissive. The magnetic particles are charged in a mold and pressed at a load of 1 t/cm$^2$ in a magnetic field of 10 kOe to form a preformed body. The density of the preformed body is about 80%, and has continuous spaces from the bottom surface to the upper surface of the preformed body. Only the bottom surface of the preformed body is immersed in the solution that is optically transmissive. The bottom surface is a side parallel to the direction of magnetic field. The solution begins to soak from the bottom surface and the side surface into the spaces between adjacent magnetic particles, and evacuation causes the solution that is optically transmissive to be impregnated on the surface of the magnetic particles surrounding the spaces between the adjacent magnetic particles. Next, the solvent of the solution that is optically transmissive is evaporated along the continuous spaces or gaps, the hydrated water is evaporated by heating, and the magnetic powder is held at about 1,100° C. in a vacuum heat treatment oven to sinter it. Upon sintering, Dy, C, and F that constitute the fluoride compound diffuse along the surface and the grain boundary of the magnetic particles, and there occurs mutual diffusion in which Dy, C, and F are exchanged with Nd and Fe that constitutes the magnetic particles. The diffusion in which Dy is exchanged for Nd progresses, in particular near the grain boundaries and a structure in which Dy is segregated along the grain boundary is formed. As a result, it is revealed that the fluoride compound and oxyfluoride compound are formed at triple points of the grain boundaries, which are comprised by $DyF_3$, $DyF_2$, DyOF, etc. Such a sintered magnet exhibited a 40% increase in coercive force, a decrease in residual magnetic flux due to the increase in the coercive force is 2%, and a 10% increase in Hk as compared with the case where no fluoride compound has been used. The sintered magnet impregnated with the fluoride compound has high energy product, so that it can be applied to a rotating machine for use in hybrid cars.

Third Embodiment

The DyF-based processing liquid is prepared by dissolving Dy acetate in water and gradually adding to the resultant solution hydrofluoric acid that has been diluted. The resultant solution that contained gel-like precipitation of a fluoride compound in admixture with an oxyfluoride compound and an oxyfluoride carbide compound is stirred with an ultrasonic stirrer. After centrifugation, methanol is added to the sediments to obtain a gelatinous methanol solution, which then was stirred and anions are removed to make the solution transparent. Anions are removed from the processing liquid to such an extent that the optical transmittance of the processing liquid became 5% or more. This solution was impregnated to the preformed body. The preformed body or green compact is fabricated by compacting $Nd_2Fe_{14}B$ magnetic powder in a magnetic field of 10 kOe under a load of 5 t/cm$^2$ and has a thickness of 20 mm and a density of 80% on average. Thus the preformed body has a density less than 100%, which indicates that there are continuous voids or spaces in the preformed body. The above-mentioned solution was impregnated in these spaces in amounts of about 0.1 wt %. The preformed body was brought in contact with the solution such that the side that is perpendicular to the direction in which a magnetic field is applied is disposed bottom to allow the solution to soak the spaces between adjacent magnetic particles. At this time evacuation results in impregnation of the solution along the spaces, so that the solution is coated to the side opposite to the bottom side. By heat treatment of the impregnated preformed body at 200° C. under vacuum causes the solvent of the coating solution to be evaporated. The impregnated preformed body after the evaporation of the solvent is placed in a vacuum heat treatment oven and heated to a sintering temperature of 1,000° C. under vacuum to effect sintering to obtain an anisotropic sintered magnet having a density of 99%. The sintered magnet that has been subjected to the impregnation treatment with the DyF-based processing liquid has a feature that it includes Dy segregated near grain boundary and contains F, Nd, and oxygen in large amounts at the grain boundary. The Dy that is present near the grain boundary increases coercive force. Thus, the Dy-impregnated sintered magnet exhibits characteristics of a coercive force of 25 kOe and a residual magnetic flux of 1.5 T at 20° C. The concentrations of Dy and F are higher at portions of the sintered magnet that served as paths of the impregnation than other portions and thus there exist differences in concentration of Dy and F. Continuous fluoride formation occurs in the direction from the surface soaked in the impregnation liquid to the opposite surface. On the contrary, there occurs discontinuous fluoride formation in the direction perpendicular to the direction from the soaked surface to the opposite surface of the sintered magnet. On average, the concentrations of DY and F are higher in the direction from the soaked surface to the opposite surface than in the direction perpendicular to the direction from the soaked surface to the opposite surface. This can be confirmed with SEM-EDX, TEM-EDX or EELS and EPMA. The impregnation treatment with DyF-based liquid and sintering can provide, in addition to the improvements in the above-mentioned characteristics, at least one of various advantageous effects including improvement of squareness of magnetic properties, an increase in resistance after molding, a decrease in dependence of coercive force on temperature, a decrease in dependence of remanent magnetic flux density on temperature, improvement of corrosion resistance, an increase in mechanical strength, improvement of heat conductivity, and an improvement of adhesion of magnet.

Examples of the fluoride compounds that can be applied to impregnation process include, besides $DyF_3$ from the DyF-based fluoride compounds, LiF, $MgF_2$, $CaF_2$, $ScF_2$, $VF_2$, $VF_3$, $CrF_2$, $CrF_3$, $MnF_2$, $MnF_3$, $FeF_2$, $FeF_3$, $CoF_2$, $CoF_3$, $NiF_2$, $ZnF_2$, $AlF_3$, $GaF_3$, $SrF_2$, $YF_3$, $ZrF_3$, $NbF_5$, AgF, $InF_3$, $SnF_2$, $SnF_4$, $BaF_2$, $LaF_2$, $LaF_3$, $CeF_2$, $CeF_3$, $PrF_2$, $PrF_3$, $NdF_2$, $SmF_2$, $SmF_3$, $EuF_2$, $EuF_3$, $GdF_3$, $TbF_3$, $TbF_4$, $DyF_2$, $NdF_3$, $HoF_2$, $HoF_3$, $ErF_2$, $ErF_3$, $TmF_2$, $TmF_3$, $YbF_2$, $YbF_3$, $LuF_2$, $LuF_3$, $PbF_2$, and BiF3. The fluoride compounds also include compounds that contain any one of the above-mentioned fluoride compounds and at least one of oxygen, carbon and transition metal elements. These fluoride compounds can be formed by impregnation treatment with a solution or liquid that is transmissive to visible light or a liquid whose solvent is composed of a compound that contains a CH group to which a portion of fluorine is connected. As a result of the impregnation treatment with one or more of the above-mentioned fluorine compounds, the fluoride compound(s) or the oxyfluoride compound(s) in the form of plates were observed in the grain boundary and inside the particles.

Fourth Embodiment

The DyF-based treating solution or liquid is prepared by dissolving Dy acetate in water and gradually hydrofluoric acid that has been diluted adding to the resultant solution. The resultant solution containing the gel-like precipitation of fluoride compound in admixture with oxyfluoride compound and oxyfluoride carbide compound is stirred with an ultrasonic stirrer. After centrifugation, methanol is added to the sediments to obtain a gelatinous methanol solution, which then is stirred and anions were removed to make the solution transparent. Anions are removed from the treating solution to such an extent that the optical transmittance of the treating solution became 10% or more. This solution is impregnated to the preformed body. The preformed body or compact is fabricated by compacting $Nd_2Fe_{14}B$ magnetic powder having an aspect ratio of 2 on average under a load of 5 t/cm$^2$ in a magnetic field of 10 kOe and had a thickness of 20 mm and a density of 70% on average. Thus the preformed body has a density less than 100%, which indicates that there are continuous voids or spaces in the preformed body. The above-mentioned treating solution was impregnated into these spaces. The preformed body is brought in contact with the treating solution with the side perpendicular to the direction in which a magnetic field is applied being disposed bottom to allow the treating solution to soak the spaces between adjacent magnetic particles. At this time evacuation results in impregnation of the solution along the spaces, so that the solution is coated to the side opposite to the bottom side. By heat treatment of the impregnated preformed body at 200° C. under vacuum causes the solvent of the coating solution to be evaporated. The impregnated preformed body after the evaporation of the solvent is placed in a vacuum heat treatment oven and heated to a sintering temperature of 1,000° C. under vacuum to effect sintering to obtain an anisotropic sintered magnet having a density of 99%. The degree of continuity of the phase containing Dy and F is higher in the direction of anisotropy than in other directions. This is because it is easier for the impregnation liquid to soak along the direction in which the magnetic particles are oriented than in other directions as a result of magnetic field orientation and because in this regard the preformed body was soaked in the treating solution such that the surface of the preformed body perpendicular to the orientation direction was soaked in order to make the direction in which magnetic field was applied was substantially identical to the direction of soaking. The average concentrations of Dy and F are higher in the direction parallel to the direction in which magnetic filed is applied than in the direction perpendicular thereto. As compared with sintered magnet fabricated without the impregnation treatment, the sintered magnet fabricated with the impregnation treatment of the preformed body with the DyF-based treating solution has a feature that it includes Dy segregated within the range of 500 nm from the grain boundary and contains F, Nd, and, oxygen in large amounts at the grain boundary. The Dy near the grain boundary increases coercive force. Thus, the Dy-impregnated sintered magnet exhibits characteristics of a coercive force of 25 kOe and a remanent magnetic flux density of 1.5 T at 20° C. The impregnation treatment with DyF-based liquid and sintering can provide, in addition to the improvements in the above-mentioned characteristics, at least one of various advantageous effects including improvement of squareness of magnetic properties, an increase in resistance after molding, a decrease in dependence of coercive force on temperature, a decrease in dependence of remanent magnetic flux density on temperature, improvement of corrosion resistance, an increase in mechanical strength, improvement of heat conductivity, and an improvement of adhesion of magnet. Examples of the fluoride compounds that can be applied to impregnation process include, besides $DyF_3$ from the DyF-based fluoride compounds, LiF, $MgF_2$, $CaF_2$, $ScF_2$, $VF_2$, $VF_3$, $CrF_2$, $CrF_3$, $MnF_2$, $MnF_3$, $FeF_2$, $FeF_3$, $CoF_2$, $CoF_3$, $NiF_2$, $ZnF_2$, $AlF_3$, $GaF_3$, $SrF_2$, $YF_3$, $ZrF_3$, $NbF_5$, AgF, $InF_3$, $SnF_2$, $SnF_4$, $BaF_2$, $LaF_2$, $LaF_3$, $CeF_2$, $CeF_3$, $PrF_2$, $PrF_3$, $NdF_2$, $SmF_2$, $SmF_3$, $EuF_2$, $EuF_3$, $GdF_3$, $TbF_3$, $TbF_4$, $DyF_2$, $NdF_3$, $HoF_2$, $HoF_3$, $ErF_2$, $ErF_3$, $TmF_2$, $TmF_3$, $YbF_2$, $YbF_3$, $LuF_2$, $LuF_3$, $PbF_2$, and $BiF_3$. The fluoride compounds also include compounds that contain any one of the above-mentioned fluoride compounds and at least one of oxygen, carbon and transition metal elements. These fluoride compounds can be formed by impregnation treatment with a liquid or solution that is transmissive to visible light or a liquid whose solvent is composed of a compound that contains a CH group to which a portion of fluorine is connected. As a result of the impregnation treatment with one or more of the above-mentioned fluorine compounds, the fluoride compound(s) or the oxyfluoride compound(s) in the form of plates are observed in the grain boundary and inside the particles.

Fifth Embodiment

The following Table 1 shows compositions of sintered magnets and increases (%) in coercive force of the sintered magnets.

TABLE 1

| | Dy Fluoride segregated sintered magnet | | Nd Fluoride segregated sintered magnet | | La Fluoride segregated sintered magnet | | Mg Fluoride segregated sintered magnet | |
|---|---|---|---|---|---|---|---|---|
| | Content in DyF solvent (Dy ratio) | Increase rate of coercive force (%) | Content in NdF solvent (Atomic %) | Increase rate of coercive force (%) | Content in LaF solvent (Atomic %) | Increase rate of coercive force (%) | Content in MgF solvent (Atomic %) | Increase rate of coercive force (%) |
| C | 10-500 (Solvent) | 3 | 10-500 (Solvent) | 3 | 10-500 (Solvent) | 4 | 0.1-30 | 6 |
| Mg | 0.0001-0.1 | 8 | 0.001-10.5 | 5 | 0.0001-3.5 | 6 | — | — |
| Al | 0.0001-0.2 | 13 | 0.0001-15.0 | 7 | 0.0001-5.0 | 11 | 0.0001-5.0 | 12 |
| Si | 0.0001-0.05 | 9 | 0.0001-10.5 | 2 | 0.0001-5.5 | 4 | 0.0001-5.5 | 7 |
| Ca | 0.0001-1.0 | 4 | 0.0001-5.5 | 9 | 0.0001-1.0 | 12 | 0.0001-1.0 | 6 |
| Ti | 0.0001-1.0 | 5 | 0.0001-7.0 | 10 | 0.0001-2.5 | 11 | 0.0001-2.5 | 5 |

TABLE 1-continued

| | Dy Fluoride segregated sintered magnet | | Nd Fluoride segregated sintered magnet | | La Fluoride segregated sintered magnet | | Mg Fluoride segregated sintered magnet | |
|---|---|---|---|---|---|---|---|---|
| | Content in DyF solvent (Dy ratio) | Increase rate of coercive force (%) | Content in NdF solvent (Atomic %) | Increase rate of coercive force (%) | Content in LaF solvent (Atomic %) | Increase rate of coercive force (%) | Content in MgF solvent (Atomic %) | Increase rate of coercive force (%) |
| V | 0.0001-1.0 | 6 | 0.0001-3.5 | 13 | 0.0001-1.5 | 5 | 0.0001-1.5 | 3 |
| Cr | 0.0001-1.0 | 12 | 0.0001-5.5 | 15 | 0.0001-2.0 | 7 | 0.0001-2.0 | 2 |
| Mn | 0.0001-1.0 | 18 | 0.0001-10.5 | 19 | 0.0001-5.0 | 11 | 0.0001-5.0 | 7 |
| Fe | 0.0001-1.0 | 6 | 0.0001-7.0 | 21 | 0.0001-7.0 | 8 | 0.0001-7.0 | 6 |
| Co | 0.0001-1.0 | 22 | 0.0001-20.5 | 33 | 0.0001-10.0 | 21 | 0.0001-10.0 | 12 |
| Ni | 0.0001-1.0 | 5 | 0.0001-15.5 | 18 | 0.0001-10.0 | 15 | 0.0001-10.0 | 7 |
| Cu | 0.0001-1.0 | 25 | 0.0001-10.0 | 31 | 0.0001-10.0 | 14 | 0.0001-10.0 | 20 |
| Zn | 0.0001-1.0 | 21 | 0.0001-10.0 | 18 | 0.0001-7.0 | 11 | 0.0001-7.0 | 21 |
| Ga | 0.0001-1.0 | 28 | 0.0001-15.0 | 21 | 0.0001-15.0 | 18 | 0.0001-15.0 | 28 |
| Ge | 0.0001-1.0 | 15 | 0.0001-13.5 | 18 | 0.0001-12.0 | 25 | 0.0001-12.0 | 13 |
| Sr | 0.0001-1.0 | 16 | 0.0001-3.5 | 12 | 0.0001-5.0 | 10 | 0.0001-5.0 | 7 |
| Zr | 0.0001-1.0 | 26 | 0.0001-17.5 | 13 | 0.0001-12.0 | 5 | 0.0001-12.0 | 5 |
| Nb | 0.0001-1.0 | 22 | 0.0001-15.0 | 21 | 0.0001-10.0 | 3 | 0.0001-10.0 | 2 |
| Mo | 0.0001-1.0 | 18 | 0.0001-10.8 | 7 | 0.0001-5.5 | 4 | 0.0001-5.5 | 13 |
| Pd | 0.0001-1.0 | 25 | 0.0001-25.5 | 22 | 0.0001-15.0 | 12 | 0.0001-15.0 | 15 |
| Ag | 0.0001-1.0 | 30 | 0.0001-15.5 | 21 | 0.0001-15.5 | 2 | 0.0001-15.5 | 18 |
| In | 0.0001-1.0 | 25 | 0.0001-15.5 | 9 | 0.0001-10.2 | 6 | 0.0001-10.2 | 17 |
| Sn | 0.0001-1.0 | 24 | 0.0001-4.4 | 5 | 0.0001-5.0 | 22 | 0.0001-5.0 | 14 |
| Hf | 0.0001-1.0 | 10 | 0.0001-7.5 | 4 | 0.0001-5.2 | 10 | 0.0001-5.2 | 6 |
| Ta | 0.0001-1.0 | 17 | 0.0001-8.5 | 2 | 0.0001-5.5 | 5 | 0.0001-5.5 | 5 |
| W | 0.0001-1.0 | 8 | 0.0001-12.5 | 5 | 0.0001-2.0 | 6 | 0.0001-2.0 | 3 |
| Ir | 0.0001-1.0 | 13 | 0.0001-15.5 | 9 | 0.0001-1.5 | 12 | 0.0001-1.5 | 5 |
| Pt | 0.0001-1.0 | 30 | 0.0001-25.5 | 25 | 0.0001-10.0 | 21 | 0.0001-10.0 | 13 |
| Au | 0.0001-1.0 | 25 | 0.0001-4.8 | 14 | 0.0001-8.0 | 18 | 0.0001-8.0 | 4 |
| Pb | 0.0001-1.0 | 11 | 0.0001-1.5 | 11 | 0.0001-5.0 | 8 | 0.0001-5.0 | 7 |
| Bi | 0.0001-1.0 | 28 | 0.0001-20.5 | 8 | 0.0001-10.6 | 4 | 0.0001-10.6 | 9 |

A series of coating compositions for forming rare earth fluoride or alkaline earth metal fluoride coating film was prepared in the following manner.

(1) In the case of a salt having high solubility in water, for example, Dy, 4 g Dy acetate was introduced in 100 ml water, and the resultant mixture was completely dissolved by using a shaker or an ultrasonic mixer.

(2) Hydrofluoric acid diluted to 10% was gradually added to the obtained solution by an equivalent for a chemical reaction by which $DyF_x$ (where x=1 to 3) is created.

(3) The solution in which gelled $DyF_x$ (where x=1 to 3) was precipitated was stirred by an ultrasonic stirrer for 1 hour or more.

(4) After centrifuging at 4,000 to 6,000 rpm, the supernatant was removed, and approximately the same volume of methanol was added.

(5) The methanol solution including gelled DyF clusters was stirred to form a complete suspension. The suspension was stirred by an ultrasonic stirrer for one hour or more.

(6) The procedures (4) and (5) were repeated three to ten times until no anions such as acetate ions and nitrate ions were detected.

(7) Finally, in the case of DyF-based fluoride compound, almost transparent sol-like $DyF_x$ (x=1 to 3) was obtained. A 1 g/5 ml methanol solution of $DyF_x$ was used as the treating solution.

(8) Each of the organ metallic compounds shown in Table 1 excepting carbon (C) was added to an aliquot of the above-mentioned solution.

The other coating compositions for forming rare earth fluoride or alkaline earth metal fluoride coating film can be prepared in substantially the same process as mentioned above. Addition of various elements to Dy, Nd, La or, Mg fluoride compound-based treating solutions as shown in Table 1 resulted in failure of coincidence of diffraction patterns of each treating solution with the diffraction patterns of the fluoride compound or oxyfluoride compound represented by $RE_nF_m$ (where RE represents a rare earth element or an alkaline earth metal element, n and m are each a positive integer) or of additive elements. Within the range of the content of the additive element shown in Table 1, the structure of the solution was not greatly changed. The diffraction pattern of the solution or of the film obtained by drying the solution was composed of a plurality of peaks including a diffraction peak whose half-value width is 1° or more. This indicates that the interatomic distance between the additive element and fluorine or between the metallic elements in the liquid or the coating film is different from that of $RE_nF_m$, and the crystalline structure is also different from that of $RE_nF_m$ (RE, m, and n are as defined above). The half-value width of the diffraction peak being 1° or larger indicated that the above-mentioned interatomic distance did not assume a constant value but had a certain distribution unlike the interatomic distance in ordinary metal crystals. The occurrence of such a distribution was due to arrangement of other atoms around the respective metal elements or fluorine atoms. The elements arranged around the metal atoms or fluorine atoms mainly included hydrogen, carbon, and oxygen. Application of external energy by heating or the like readily caused the hydrogen, carbon or oxygen atoms to migrate to change the structure and flowability of the treating solution. The X-ray diffraction pattern of the rare earth fluoride compound or alkaline earth metal fluoride compound in the form of sol or gel included peaks having a half-value width of more than 1 degree. The heat treatment caused a structural change in the rare earth fluoride compound or alkaline earth metal fluoride compound, and as a result a part of the above-mentioned diffraction patterns of $RE_nF_m$ or $RE_n(F,O)_m$ comes to appear. The additive elements shown in Table 1 would not have a long-period structure in the solution. The diffraction peak of $RE_nF_m$ had a half-value width narrower than the diffraction peaks of the above-mentioned sol or gel. It would be important that at least one peak having a half-value width of 1° or larger be observed in the diffraction pattern of the above-mentioned solution in order to increase the flowability of the solution and to make the thickness of the resultant coating film uniform. The peak of such a half-value width of 1° or larger and the peak of the diffraction pattern of $RE_nF_m$ or the peak of the oxyfluoride compound may be included. If there is observed only the diffraction pattern of $RE_nF_m$ or the oxyfluoride compound or if there is observed mainly the diffraction pattern having a half-value width of 1° or smaller in the diffraction pattern of the solution, the solution contains a solid phase as mixed with the sol or gel, so that the solution has decreased flowability and is difficult to be coated uniformly on the preformed body.

(1) A formed body or block (10×10×10 $mm^3$) obtained by compaction molding the $Nd_2Fe_{14}B$ magnetic powder to a density of 80% in a magnetic field was soaked in a DyF-based coating composition for forming a coating film and the soaked block was placed under a reduced pressure of 2 to 5 torr to remove methanol as the solvent.

(2) The operation of Step (1) was repeated 1 to 5 times and the block was heated at a temperature of 400° C. to 1,100° C. for 0.5 to 5 hours.

(3) A pulsed magnetic field of 30 kOe or more was applied to the anisotropic magnet bearing the surface coating film formed in Step (2) in an anisotropic direction.

The resulting magnetized molded article was sandwiched between magnetic poles of a direct-current M-H loop measuring device so that the magnetization direction agrees with the application direction of magnetic field. FeCo alloy was used for the pole piece in the magnetic pole to which a magnetic field was to be applied and the value of the magnetization was calibrated with a sample of pure Ni or pure Fe having the same shape.

As a result, the coercive force of the block of the NdFeB sintered compact having formed thereon the rare earth fluoride coat film increased. That is, sintered magnets in which the Dy fluoride compound or the Dy oxyfluoride compound was segregated had coercive forces that were higher by 30% and 20%, respectively, than the sintered magnet in which no additive elements were contained. The additive elements as shown in Table 1 were added to respective fluoride compound solutions using corresponding organometal compounds in order to further increase the coercive force that increased by the coating and heat treatment of the additive elements-free solution. It turned out that the additive elements in the solutions shown in Table 1 further increased the coercive force of the sintered magnet as compared with the coercive force of the additive elements-free solution as a standard and that the additive elements contributed to an increase in coercive force. The results of rate of increase of coercive force are shown in Table 1. A short range structure was observed near the added elements as a result of the removal of the solvent and further heat treatment resulted in diffusion of the added elements together with the elements that constituted the solution along the surface of the magnetic particles of the molded article. These additive elements showed the tendency of being segregated in an area near the grain boundary together with some of the elements that constituted the solution. Therefore, the additive elements shown in Table 1 diffused as attended with at least one element of fluorine, oxygen, and carbon at the sintered magnet grain boundary, and stayed in the area near the grain boundary. In the block of sintered magnet, there were observed concentration gradients of fluorine and at least one of the additive elements shown in Table 1 from the outer periphery side to the inside of the crystal grains in the sintered magnet. There was formed on the outermost surface of the block of sintered magnet an oxyfluoride compound that contained any one of the elements shown in Table 1, an oxyfluoride compound that contains any one of the element shown in Table 1 and carbon, or an oxyfluoride compound that contains at least one of the elements shown in Table 1 and at least one of the elements that constitute the sintered magnet. Such an outermost surface layer is necessary for improving the magnetic properties of the sintered magnet in addition to securing corrosion resistance of the sintered magnet. The contents of additive elements shown in Table 1 substantially correspond to their contents in the range where the solution is transmissive to light. With the contents of the additive elements in that range, improvement in the magnetic properties was observed. More particularly, it was possible to make a solution even if the concentration of the additive element was further increased. It was also possible to increase coercive force. Even when any one of the elements shown in Table 1 was added to either of the fluoride compound, the oxide compound, or the oxyfluoride compound that contained at least one slurry-like rare earth element, the sintered magnet had a coercive force higher than that of the case where no such additive elements were added. There was observed the tendency that the structure of the fluoride compound that constituted the solution changed to make the distribution of the additive elements in the solution nonuniform and prevent the diffusion of other elements.

The role of additive elements shown in Table 1 was any one of the following roles: 1) to segregate additive elements in the grain boundary vicinity and the surface energy is decreased; 2) to improve lattice match at the grain boundary; 3) to reduce defects at the grain boundary; 4) to promote grain boundary diffusion of the rare earth element etc.; 5) To improve magnetic anisotropic energy in the grain boundary vicinity; and 6) to smooth interface with the fluoride compound or the oxyfluoride compound. As a result, there was obtained by impregnation coating and diffusion by heat treatment, either one of the following advantageous effects. That is, there was observed either one of an increase in coercive force, improvement of squareness of demagnetization curve, an increase in remanent magnetic flux density, an increase in energy product, an increase in Curie temperature, a decrease in magnetization magnetic field, a decrease in dependence of coercive force and remanent magnetic flux density on temperature, an improvement of corrosion resistance, an increase in specific resistance, or a decrease in heat demagnetization rate. The concentration distribution of the additive elements shown in Table 1 showed the tendency that the concentration of the additive element decreases from the outer periphery to the inside of a crystal grain on the average, becoming a high concentration in the grain boundary part. The width of the grain boundary tends to differ between the grain boundary triple point and a site remote from the grain boundary triple point, with the grain boundary triple point vicinity having a larger width than the site remote from the grain boundary triple point. The additive elements shown in Table 1 were prone to be segregated either in the grain boundary phase or at the edge of the grain boundary, or outer peripheral part (grain boundary side) in the grain as seen from the grain boundary toward inside of the grain. The additives in the solution of which the effect of improving the magnetic properties of the above-mentioned magnet was confirmed includes an element selected from among elements having an atomic number of 18 to 86 including Mg, Al, Si, Ca, Ti, V, Cr, Mn, Fe, Co, Ni, Cu, Zn, Ga, Ge, Sr, Zr, Nb, Mo, Pd, Ag, In, Sn, Hf, Ta, W, Ir Pt, Au, Pb, and Bi shown in Table 1 and all the transition metal elements. At least one of these elements and fluorine showed concentration gradients in the crystal grains of the sintered magnet. Additive elements were used in the form of solutions in the impregnation treatment and then they were heated for diffusion. For this reason, unlike the compositional distribution of the elements added to the sintered magnet in advance, the above-mentioned additive elements occurred in high concentrations in the area near the grain boundary where fluorine was segregated whereas segregation of the elements added to the sintered magnet in advance was observed in the area near the grain boundary where segregation of a small amount of fluorine was observed (within a distance of 1,000 nm on average from the center of the grain boundary). When the additive elements are present in low concentrations in the solution, their presence can be confirmed as a concentration gradient or a concentration difference near the grain boundary triple point. Thus, when the solution to which the additive element had been added was applied to a magnet block by impregnation and the impregnated magnet block was heated to improve the magnetic properties of the resultant sintered magnet, the magnet had the following features. 1) The concentration gradient or the average concentration difference of elements having an atomic number of 18 to 86 including the element shown in Table 1 or the transition metal elements is observed along a direction of from the outermost surface of to the inside of the crystal grains of the sintered magnet. 2) In a lot of parts, the segregation near the grain boundary of one or more of the elements having atomic number of 18 to 86 including the elements shown in Table 1 or the transition elements occurs as accompanied by fluorine. 3) The concentration of fluorine is higher in the grain boundary phase and lower on the outside of the grain boundary phase. Near the grain boundary where there is observed a concentration difference of fluorine, there occurs segregation of one or more of the elements that constitute the impregnation liquid having an atomic number of 18 to 86 including the elements shown in Table 1 or the transition elements. 4) At least one of the elements that constitute the solution including elements having an atomic number of 18 to 86 including the additive elements shown in Table 1 or the transition elements has a concentration gradient from the surface toward inside of crystal grains. The fluorine concentration is maximal near the grain boundary between the magnet and the fluorine-containing film that has grown on the magnet from the solution or a part outside the grain boundary as seen from the magnet. The fluoride compound near the grain boundary contains oxygen or carbon, which contributes to either of high corrosion resistance or high electrical resistance, or high magnetic properties. In this fluorine containing film, there is detected at least one element from among the elements having an atomic number of 18 to 86 elements including the additive elements shown in Table 1 or the transition elements. The above-mentioned additive elements are contained in higher concentrations near the impregnation paths of fluorine in the magnet than in other portions, and there is observed any one of the effects including an increase in coercive force, an improvement of squareness of demagnetization curve, an increase in remanent magnetic flux density, an increase in energy product, an increase in Curie temperature, a decrease in magnetization field, a decrease in dependence of coercive force and remanent magnetic flux density on temperature, an improvement of corrosion resistance, an increase in specific resistivity, a decrease in heat demagnetization rate, and an increase in magnetic specific heat. The concentration difference of the above-mentioned additive element or elements can be confirmed by analyzing the crystal grain of the sintering block by EDX (energy dispersive x-ray) profile of a transmission electron microscope, EPMA (electron probe micro-analysis) and ICP (inductively coupled plasma) analysis, or the like. It can be analyzed EDX of the transmission electron microscope and EELS (electron energy-loss spectroscopy) that the element or elements having an atomic number of 18 to 86 added to the solution segregate near the fluorine atom (for example, within 2,000 nm, preferably within 1,000 nm from the position where the segregation of the fluorine atom occurs). Such a compositional analysis indicated that in the case of a preformed body that had been impregnated with the DyF solution under vacuum of 200 Pa, a continuous layer of the fluoride compound was formed in the direction of the impregnation and the continuous layer of the fluoride compound contains granular oxyfluoride compound at the triple point of the grain boundary. The layer of the fluoride compound or the oxyfluoride compound formed by such a vacuum impregnation treatment was continuous from one side to the opposite side of the sintered magnet in the direction of impregnation. Therefore, in a direction perpendicular to the direction of impregnation, the volume of the fluoride compound tended to be smaller than in other directions. In the continuous layer of the fluoride compound or the oxyfluoride compound, Nd was in larger amounts than Dy and F, C, and O were detected, with Dy being diffused from the grain boundary toward the inside of the grain. The continuous layer of the fluoride compound or the oxyfluoride compound was in larger amounts in a direction parallel to the direction of impregnation than in a direction perpendicular to the direction of impregnation.

Sixth Embodiment

The rare earth permanent magnet according to this example is a sintered magnet that was obtained by diffusing fluorine and a G component (hereafter, "G") consisting of one or more elements selected from the transition metal elements and one or more rare earth elements, or of one or more transition metal elements and one or more alkaline earth metal elements into an R—Fe—B (R represents a rare earth element) sintered magnet through the surface thereof. It has a chemical composition represented by the following formula (1) or (2).

$$R_aG_bT_cA_dF_eO_fM_g \quad (1)$$

$$(R.G)_{a+b}T_cA_dF_eO_fM_g \quad (2)$$

In the above formulae (1) and (2), R represents one or more elements selected from rare earth elements. M represents an element belonging to Group 2 to Group 16 excepting the rare earth element, C, and B, the element existing in the sintered magnet before the fluorine-containing solution is applied thereto. While G represents elements consisting of one or more elements selected from the transition metal elements and one or more rare earth elements, or of one or more transition metal elements and one or more alkaline earth metal elements as mentioned above, "R" and "G" may have the same elements. The composition of the sintered magnet is represented by the formula (1) and by the formula (2) when R and G do not contain the same elements. "T" represents one or two elements selected from Fe and Co. "A" represents one or two elements selected from B (boron) and C (carbon). "a" to "g" (a-g) each represent atomic percents of the alloy, and "a" and "b" satisfy: $10 \leqq a \leqq 15$, and $0.005 \leqq b \leqq 2$ for the formula (1), or $10.005 \leqq a+b \leqq 17$ for the formula (2); $3 \leqq d \leqq 15$; $0.01 \leqq e \leqq 4$; $0.04 \leqq f \leqq 4$; $0.01 \leqq g \leqq 11$; and the balance being "c".

This rare earth permanent magnet has the following features. That is, at least one element selected from F and the transition metal elements that constitute the rare earth permanent magnet is distributed such that the concentration thereof increases on average from the center of the magnet toward the surface of the magnet. In the grain boundary part that surrounds main phase crystal grains consisting of tetragonal $(R,G)_2T_{14}A$ in the sintered magnet, the concentration of G/(R+G) included in the grain boundary is higher on average than the concentration of G/(R+G) in the main phase crystal grain. The oxyfluorides, the fluorides, or the oxyfluoride carbide of R and G exist in a depth region of at least 10 μm from the surface of the magnet in the grain boundary part. The coercive force near the surface layer of the magnet is higher than the inside of the magnet. A concentration gradient of the transition metal element is observed in the direction of from the surface of the sintered magnet toward the center of the sintered magnet. The rare earth permanent magnet can be produced, for example, by the following method.

A treating solution for forming a rare earth fluoride coating film to which the element "M", one of the transition metal elements listed in Table 1, was added having the composition of $(Dy_{0.9}M_{0.1})F_x$ (x=1 to 3) was prepared as follows.

(1) 4 g of a salt having a high solubility in water, such as Dy acetate or Dy nitrate for Dy was added to 100 ml water, and the resultant mixture was completely dissolved by using a shaker or an ultrasonic mixer.

(2) Hydrofluoric acid diluted to 10% was gradually added by an equivalent amount for a chemical reaction by which $DyF_3$ is produced.

(3) The solution in which gelled $DyF_x$ (where x=1 to 3) was precipitated was stirred by an ultrasonic stirrer for 1 hour or longer.

(4) After the solution was centrifuged at a speed of 4,000 to 6,000 rpm, the supernatant was removed, and methanol of approximately the same volume as that of the removed supernatant was added to the residue.

(5) The methanol solution including gelled DyF clusters was stirred to form a complete suspension. The suspension was stirred by an ultrasonic stirrer for 1 hour or longer.

(6) The procedures (4) and (5) were repeated three to ten times until no anions such as acetate ions and nitrate ions were detected.

(7) In the case of DyF-based fluoride compound, almost transparent sol-like $DyF_x$ (x=1 to 3) was obtained. A 1 g/5 ml methanol solution of $DyF_x$ (x=1 to 3) was used as the treating solution.

(8) An organometal compound listed in Table 1 excepting carbon (C) was added to the solution.

It was also possible to prepare the other coating solutions for forming rare earth fluoride or alkaline earth metal fluoride coating film by substantially the same process as that mentioned above. Addition of various elements to Dy, Nd, La or, Mg fluoride compound-based treating solutions as listed in Table 1 results in a failure of coincidence of diffraction patterns of each treating solution with the diffraction patterns of the fluoride compound or oxyfluoride compound represented by $RE_nF_m$ (where RE represents a rare earth element or an alkaline earth metal element; n, m, p and r are each a positive integer) or of additive elements. The structure of the solution was not greatly changed by the additive element when the content thereof was within the range shown in Table 1. The diffraction pattern of the solution or of a film obtained by drying the solution included a plurality of peaks each having a diffraction peak whose half-value width was 1° or larger. This indicated that the treating solution was different from $RE_nF_m$ in respect of an interatomic distance between the additive element and fluorine or between the metallic elements, and also in respect of the crystalline structure. The half-value width of the diffraction peak being 1 degree or larger indicated that the above-mentioned interatomic distance did not assume a constant value but had a certain distribution unlike an ordinary metal crystal having a constant interatomic distance. Such a distribution was formed due to presence of other atoms mainly including hydrogen, carbon, and oxygen, arranged differently from those in the above-mentioned compounds, around the atom of metal element or fluorine. The application of external energy such as heat caused the atoms of hydrogen, carbon, oxygen, etc. to easily migrate, resulting in a change in structure and fluidity of the treating solution. The X-ray diffraction patterns of the sol and the gel that included peaks having half-value widths larger than 1° underwent a structural change by heat treatment and some of the above-mentioned diffraction patterns of $RE_nF_m$ or $RE_n(F,O)_m$ came to appear. The additive elements listed in Table 1 did not have a long-period structure in the solutions. The diffraction peak of the $RE_nF_m$ had a half-value width narrower than that of the diffraction peak of the sol or gel. It was important for the diffraction pattern of the above-mentioned solution to include at least one peak having a half-value width of 1° or larger in order to increase the flowability of the solution and to make the thickness of the resultant coating film uniform. The peak of such a half-value width of 1° or larger and the peak of the diffraction pattern of the $RE_nF_m$ or the peak of the oxyfluoride compound may be included in the diffractive pattern of the solution. When only the diffraction pattern of the $RE_nF_m$ or the oxyfluoride compound was observed, or when mainly the diffraction pattern having a half-value width of 1° or smaller was observed in the diffraction pattern of the solution, the solution contained mixed therein a solid phase, not in a sol or gel state, so that the solution had poor flowability. However, an increase in coercive force was observed. The fluoride compound solution was coated on the preformed body by the following steps.

(1) A molding in a magnetic field of NdFeB (10×10×10 $mm^3$) was compaction molded at room temperature and immersed in a coating solution for forming a DyF-based coating film. The soaked block was placed under a reduced pressure of 2 to 5 torr to remove methanol as the solvent.

(2) The operation of Step (1) was repeated 1 to 5 times and the block was heated at a temperature of 400° C. to 1,100° C. for 0.5 to 5 hours.

(3) A pulsed magnetic field of 30 kOe or stronger was applied to the anisotropic magnet provided with a surface coating film formed in Step (2) in the direction of anisotropy.

A magnetization curve of the magnetized compact was prepared based on results of measurements performed by placing the compact between the magnetic poles of a direct-current (DC) M-H loop measuring device so that the magnetization direction of the compact agreed with the direction of the applied magnetic field. FeCo alloy was used for the magnetic pole pieces for use in applying a magnetic field to the magnetized compact were made of a FeCo alloy. The values of the magnetization were corrected using a pure Ni sample or a pure Fe sample having the same shape.

As a result, the block of NdFeB sintered body having formed thereon the rare earth fluoride coating film had an increased coercive force. By using the treating solution to which the transition metal element was added, the sintered body acquired a higher coercive force than that of a sintered magnet having no additive element. Such a further increase of the coercive force which had already been increased by the coating of the solution with no additive element and by the subsequent thermal treatment indicated that these additive elements contributed to the increase of coercive force. A short range structure was observed near the added elements as a result of the removal of the solvent and a further heat treatment resulted in diffusion of the added elements together with the elements that constituted the solution along the sintered magnet. These additive elements showed a tendency of being segregated near grain boundary vicinity together with some of the elements that constituted the solution. The chemical composition of the sintered magnet that showed a high coercivity was such that the concentration of the element that constituted the fluoride solution showed a tendency of being high on the surface in contact with the impregnation solution and low on a surface opposite to or perpendicular to that surface. This is because when the impregnation solution was contacted with one side of the magnetized compact to coat and impregnate the fluoride solution containing the additive element onto the compact and the impregnated compact was dried and sintered, the fluoride or the oxyfluoride compound containing the additive element and having the short range structure grew on the outer surface of the compact and also progressively diffused along the vicinity of the grain boundary. The impregnation solution was spread according to the continuous space along the surface of the magnetic particles, and a continuous layer of the fluoride compound was formed. Such a continuous layer of the fluoride compound became continuous in the direction of the impregnation, and did not become continuous in a direction perpendicular to the direction of the impregnation. Moreover, the concentration gradients of fluorine and at least one of the additive elements listed in Table 1 were observed ranging from the periphery to the inside of the sintered magnetic block. The content of the additive element listed in Table 1 substantially corresponded to the range of the content in which the solution was transmissive to light. When any element of the atomic numbers from 18 to 86 was added to one of a fluoride compound, oxide compound, and oxyfluoride compound including at least one rare earth element in a slurry form, there was observed an improvement in magnetic properties, such as a high coercive force compared to the case where no additive element was added. The additive elements have any of the following roles: 1) to reduce an interface energy by being segregated near a grain boundary; 2) to increase the lattice matching of a grain boundary; 3) to reduce defects at a grain boundary; 4) to promote grain boundary diffusion of the rare earth element and the like; 5) to increase a magnetic anisotropic energy near a grain boundary; 6) The interface with the fluoride compound, the oxyfluoride compound, or the carbide oxyfluoride compound is smoothed; 7) to increase anisotropy of a rare earth element; and 8) to remove oxygen from the matrix; and 9) to raise the Curie temperature of the matrix. As a result, there was observed either one of the following advantageous effects, i.e., an increase in coercive force, improvement of squareness of a demagnetization curve, an increase in remanent magnetic flux density, an increase in energy product, an increase in the Curie temperature, a decrease in magnetization magnetic field, a decrease in dependence of coercive force and remanent magnetic flux density on temperature, an improvement of corrosion resistance, an increase in specific resistance, or a decrease in heat demagnetization rate. The concentration distribution of the additive elements listed in Table 1 showed that the concentration of the additive element decreased from the periphery to the inside of the sintered magnet on the average, and the concentration of the additive element was high in the grain boundary part. The widths of the grain boundaries tended to differ between an area near the grain boundary triple point and a site remote from the grain boundary triple point, with the width near the grain boundary triple point being larger and the concentration of the transient metal element being higher than at the site remote from the grain boundary triple point. The transition metal additive elements tended to segregate in a grain boundary phase, at the edge of the grain boundary, or in a peripheral part (grain boundary side) of the grain ranging from the grain boundary towards the interior of the grain. Since these additive elements were caused to diffuse by heating after the treatment with their solution, they were highly concentrated near the grain boundary where the fluorine or rare earth element segregates, unlike the composition distribution of the element added to the sintered magnet in advance while the pre-added element segregated in the grain boundary where little segregation of the fluorine occurred. This resulted in an averaged concentration gradient that was observed from the outermost surface of the magnet block to the inside thereof, with the concentration being highest on the side where the magnetic block was immersed in the impregnation solution and the concentration being lower than the concentration being lower on the opposite side. When the concentration of the additive element was low in the solution, the concentration gradient or concentration difference of the additive element was observed. As described above, when a magnet block was coated with a solution including an additive element, and then heated for improvement of the characteristics of a sintered magnet, the sintered magnet thus obtained exhibited the following characteristics. 1) A concentration gradient or an average concentration difference of the transition metal element was observed from the outermost surface of the sintered magnet toward the inside thereof; 2) The segregation of the transition metal element along with fluorine was observed near the grain boundary and the fluoride compound was continuously formed from edge to edge of the sintered magnet. An average amount of the laminar fluoride compound differed between the direction of impregnation and a direction perpendicular thereto. 3) The concentration of fluorine was high in the grain boundary phase and low outside the grain boundary phase, the fluorine concentration is low, the segregation of the transition metal element was observed near a region where a difference in fluorine concentration was observed, and an average concentration gradient or concentration difference was observed from the surface of the magnet block to the inside thereof. 4) A fluoride compound layer or an oxyfluoride compound layer, containing the transition metal element, fluorine, and carbon grew on the outermost surface of the sintered magnet.

Seventh Embodiment

A rare earth permanent magnet, which was a sintered magnet, was obtained by causing a fluorine atom and a G component (G represents elements consisting of at least one element selected from transition metal elements and at least one element selected from rare earth elements, or at least one element selected from transition metal elements and at least one element selected from alkaline earth metal elements) to diffuse into an R—Fe—B-based sintered magnet (R represents a rare earth element) from the surface thereof. The composition of the rare earth permanent magnet is expressed by one of the following composition formulae (1) and (2):

$$R_aG_bT_cA_dF_eO_fM_g \quad (1)$$

$$(R.G)_{a+b}T_cA_dF_eO_fM_g \quad (2)$$

(In these formulae: R represents at least one element selected from rare earth elements; M represents the elements of Groups 2 to 16, excluding the rare earth element existing within the sintered magnet before the coating of a solution containing fluorine, and also excluding C and B; and G represents elements consisting of at least one element selected from transition metal elements and at least one element selected from rare earth elements, or at least one element selected from transition metal elements and at least one element selected from alkaline earth metal elements. R and G may contain the same element. The formula (1) expresses the composition of the magnet in which R and G do not contain the same element, while the formula (2) expresses the composition of the magnet in which R and G contain the same element. "T" represents one or two elements selected from Fe and Co, and "A" represents one or two elements selected from B (boron) and C (carbon). Lower-case letters a to g represent atomic percents in the alloy: in the formula (1), $10 \leqq a \leqq 15$, $0.005 \leqq b \leqq 2$; and, in the formula (2), $10.005 \leqq a+b \leqq 17$, $3 \leqq d \leqq 15$, $0.01 \leqq e \leqq 10$, $0.04 \leqq f \leqq 4$, $0.01 \leqq g \leqq 11$, and the balance is c.) In the rare earth permanent magnet, at least one of the constituent elements F, metalloid elements, and transition metal elements had a distribution in which the concentration averagely became higher from the center of the magnet to the surface thereof. The rare earth permanent magnet also had an averagely higher G/(R+G) concentration in the crystal grain boundary part surrounding the main phase crystal grain composed of tetragonal $(R, G)_2T_{14}A$ than the G/(R+G) concentration in the main phase crystal grain. Moreover, the rare earth permanent magnet included an oxygen-fluoride, fluoride, or fluoride carbonate of R and G in the region of the crystal grain boundary at least 1 μm distant in depth from the magnet surface. Furthermore, the rare earth permanent magnet had a higher coercive force near the magnet surface than that in the inside thereof. As one of the characteristics, a gradient of transition metal element concentration was observed from the surface of the sintered magnet towards the center thereof. The rare earth permanent magnet was prepared, for example by the following method.

A treating solution for forming a rare earth fluoride or alkaline earth metal fluoride coating film to which a transition metal element was added was prepared according to the following steps.

(1) 4 g of a salt having a high solubility to water, such as dysprosium acetate or dysprosium nitrate for Dy, was added to 100 ml of water, and dissolved completely using a shaker or an ultrasonic stirrer.

(2) Hydrofluoric acid (HF) diluted to 10% was gradually added to the obtained solution by an equivalent for a chemical reaction to generate which $DyF_x$ (where x=1 to 3).

(3) The solution in which gelled $DyF_x$ (where x=1 to 3) was precipitated was stirred by an ultrasonic stirrer for 1 hour or longer.

(4) After centrifuging at 4,000 to 6,000 rpm, the supernatant was removed, and approximately the same volume of methanol was added.

(5) After the methanol solution containing a gelled DyF-, DyFC-, or DyFO-based cluster was thoroughly stirred to form a uniform suspension, the obtained suspension was stirred for 1 hour or longer using an ultrasonic stirrer.

(6) The operations of the steps (4) and (5) above were repeated 3 to 10 times until anion such as acetate ion or nitrate ion was no longer detected.

(7) In the case of DyF system, almost transparent $DyF_x$ in a sol form containing C and/or O was obtained. The methanol solution containing 1 g of $DyF_x$ per 5 ml of the solution was adopted as the treating solution.

(8) Each of the organometal compounds listed in Table 1 except for carbon (C) was added to an aliquot of the above-mentioned solution.

It was also possible to prepare the other coating solutions used for forming rare earth fluoride or alkaline earth metal fluoride coating film by almost the same process as that mentioned above. Even if various elements were added to the fluorine-based treating solutions containing a rare earth element, such as Dy, Nd, La, or Mg, or an alkaline earth element, the resultant solutions did not exhibit a diffraction pattern corresponding to that of a fluoride compound or an oxyfluoride compound expressed as $RE_nF_m$ (RE represents a rare earth element or an alkaline earth element; n and m represent positive numbers) or $RE_nF_mO_pC_r$ (RE represents a rare earth element or an alkaline earth element; O, C, and F represent oxygen, carbon, and fluorine, respectively; n, m, p, and r are positive numbers), or a compound with an additive element. It was observed that the diffraction pattern of the solutions or a film formed by drying the solutions included multiple peaks as the main peaks each having a half-value width of 1° or larger. This indicated that the treating solution was different from that of the $RE_nF_m$ in terms of an interatomic distance between the additive element and fluorine, or between the metal elements, and also in terms of crystalline structure. The half-value width of the diffraction peak being 1° or larger indicated that the above-mentioned interatomic distance did not assume a constant value but had a certain distribution unlike the interatomic distance in ordinary metal crystals. The occurrence of such a distribution was due to the arrangement of other atoms around the respective metal elements or fluorine atoms. The elements arranged around the metal atoms or fluorine atoms mainly include hydrogen, carbon, and oxygen. Application of external energy such as heating readily causes the hydrogen, carbon or oxygen atoms to migrate to change the structure and flowability of the treating solution. The X-ray diffraction pattern of the sol and the gel, whose peaks had a half-value width larger than 1.degree., exhibited a structural change by a thermal treatment, and some of the diffraction patterns of the $RE_nF_m$, $RE_n(F, C, O)_m$ (the ratio of F, C, and O is arbitrary), or $RE_n(F, O)_m$ (the ratio of F and O is arbitrary) occurred. The diffraction peaks of the $RE_nF_m$ or the like had narrower half-value widths than that of the above-described sol or gel. It was important that at least one peak having a half-value width of 1° or larger was observed in the diffraction pattern of the above-mentioned solution in order to increase the flowability of the solution and to make the thickness of the resultant coating film uniform.

(1) A compact ($10 \times 10 \times 10$ $mm^3$) of NdFeB particles obtained by compaction molding the NdFeB powder in a magnetic field was soaked in a treating solution for forming a Dy—F based coating film and the soaked compact was placed under a reduced pressure of 2 to 5 torr to remove the solvent methanol.

(2) The operation of Step (1) was repeated 1 to 5 times and the soaked compact was heated at a temperature of 400° C. to 1,100° C. for 0.5 to 5 hours.

(3) A pulsed magnetic field of 30 kOe or stronger was applied to the sintered magnet or the NdFeB-based magnetic powder provided with a surface coating film in the step (2) in the anisotropy direction.

A demagnetization curve of the magnetized sample was measured by placing the sample between the magnetic poles of a DC M-H loop measurement device such that the magnetization direction of the compact agreed with the direction of the applied magnetic field, and then applying the magnetic field between the magnetic poles. The magnetic pole pieces for the application of the magnetic field to the magnetized sample were made of a FeCo alloy. The values of magnetization were corrected using a pure Ni sample and a pure Fe sample having the same shape.

As a result, the block of NdFeB sintered body having the rare earth fluoride coating film formed thereon acquired an increased coercive force. By using the treating solution added with the transition metal element, the sintered body acquired a higher coercive force or squareness of the demagnetization curve than that of a sintered magnet having no additive element. Such a further increase of the coercive force or the squareness which had been already increased by the coating of the solution with no additive element and by the subsequent thermal treatment indicated that these additive elements contributed to the increase of coercive force. Near the element added to the solution, a short-range structure was observed due to the removal of the solvent. Further heating caused the element to diffuse together with the constituent element of the solution along the grain boundary of the sintered magnet. These additive elements showed the tendency of segregating near a grain boundary together with some of the elements that constituted the solution. The sintered magnet exhibiting a high coercive force had a composition such that (Nd, Dy) (O, F) was generated on the outermost surface thereof. The crystal particle size of this compound was 0.5 to 5 μm, which was larger than the particle size of the oxyfluoride compound in the inside of the magnet ranging 0.01 to 0.5 μm. Moreover, the particle size of the oxyfluoride compound tended to be larger on the side of the sintered magnet that was immersed in the impregnation solution and smaller on the opposite side. A concentration gradient of carbon existed in the (Nd,Dy) (O,F) on the outermost surface of the sintered magnet. There was observed a tendency that on the outer side of the (Nd, Dy) (O, F) as seen from the sintered magnet, a larger amount of C was present and an oxyfluoride compound containing carbon, (Nd, Dy) (O, F, C) partly grew on the outermost surface. Moreover, the concentration of Nd was higher than that of Dy in the (Nd,Dy) (O,F) on the outermost surface. It was presumed that Dy diffused into the inside of the sintered magnet and mutually diffused with Nd, resulting in an exchange between Nd and Dy. The amount of oxygen in the (Nd, Dy) (O,F) on the outermost surface depends on the concentration of oxygen in the magnetic powder, and showed a tendency to become the lower, the lower the concentration of oxygen in the magnetic powder. It became $(Nd,Dy)F_x$ (x=1 to 3) locally. The particle size of the oxyfluoride compound or the fluoride compound was larger than that of the oxyfluoride compound or the fluoride compound in the inside of the magnet. The concentration of Nd was higher than that of Dy. The concentration of F was higher than that of Nd on average. The concentration of Nd was higher in the inside of the magnet than otherwise. This is because when the fluoride solution containing the additive element was applied by impregnation on the outer side of the sintered magnet block and dried, a fluoride compound or oxyfluoride compound containing the additive element and having a short-range structure grew and at the same time diffusion thereof proceeded along the vicinity of the grain boundary. That is, there was observed concentration gradients or concentration differences of fluorine and of at least one element of the additive element of the transition metal elements or the semimetal elements listed in Table 1 from the periphery that served an impregnation side toward the inside of the sintered magnetic block. Continuity of the (Nd,Dy)(O,F) layer was different between the direction parallel to the impregnation direction and the direction perpendicular to the impregnation direction. The continuity the (Nd,Dy) (O,F) layer was high in the direction parallel to the impregnation direction while in the direction perpendicular to the impregnation direction, the continuity of the (Nd,Dy) (O,F) layer was not observed in most portions thereof. When the direction of the impregnation was a direction of the anisotropy, the continuity of the (Nd, Dy) (O,F) layer was high in a direction parallel to the magnetization direction. In this direction, the volume of the fluoride compound was larger. The (Nd,Dy) (O,F) layer tended to have a larger film thickness (10 nm on average) in the direction parallel to the impregnation direction than in the direction perpendicular thereto (7 nm on average).

Eighth Embodiment

A series of coating solutions for forming rare earth fluoride or alkaline earth metal fluoride coating film was prepared by the following method.

(1) 4 g of a salt having a high solubility to water, such as neodymium acetate or neodymium nitrate for Nd, was added to 100 ml of water, and dissolved completely using a shaker or an ultrasonic stirrer.

(2) HF diluted to 10% was gradually added in an equivalent amount for a chemical reaction to generate $NdF_xC_y$ (x and y are positive numbers).

(3) The solution in which a gelled precipitation of $NdF_xC_y$ (x and y are positive numbers) was generated was stirred for 1 hour or longer using an ultrasonic stirrer.

(4) After centrifuging at 4,000 to 6,000 rpm, the supernatant was removed, and approximately the same volume of methanol was added.

(5) The methanol solution including gelled $Nd_yF$ clusters was stirred to form a complete suspension. The suspension was stirred by an ultrasonic stirrer for 1 hour or longer.

(6) The procedures (4) and (5) were repeated three to ten times until no anions such as acetate ions and nitrate ions were detected.

(7) In the case of NdFC system, almost transparent $NdF_xC_y$ (x and y are positive numbers) in a sol form was obtained. The methanol solution containing 1 g of $NdF_xC_y$ (x and y are positive numbers) per 5 ml of the solution was adopted as the treating solution.

(8) Each of the organometal compounds shown in Table 1 excepting carbon (C) was added to an aliquot of the above-mentioned solution.

It was possible to prepare the other treating solutions used for forming a coating film mainly containing a rare earth fluoride or alkaline earth metal fluoride by following the almost same steps as described above. Even if being added with various elements, the fluorine-based treating solutions containing Dy, Nd, La, Mg as shown in Table 1, alkaline earth element, and Group 2 element did not exhibit a diffraction pattern corresponding with that of a fluorine compound expressed as $RE_nF_mC_p$ (RE represents a rare earth element or an alkaline earth element; n, m, and p represent positive numbers), an oxyfluoride compound or a compound with an additive element. Within the range of the content of the additive element shown in Table 1, the structure of the solution is not greatly changed. It was observed that the diffraction pattern of the solution or a film formed by drying the solution included multiple peaks each having a half-value width of 1° or larger. This indicated that the treating solution was different from that of $RE_nF_mC_p$ in terms of an interatomic distance between the additive element and fluorine, or between the metal elements, and also in terms of crystalline structure. The half-value width of the diffraction peak being one degree or more indicated that the above-mentioned interatomic distance did not assume a constant value but had a certain distribution unlike the interatomic distance in ordinary metal crystals. The occurrence of such a distribution was due to arrangement of other atoms around the respective metal elements or fluorine atoms. The elements arranged around the metal atoms or fluorine atoms mainly included hydrogen, carbon, and oxygen. Application of external energy by heating or the like readily causes the hydrogen, carbon or oxygen atoms to migrate to change the structure and flowability of the treating solution. The X-ray diffraction pattern of the sol and the gel, whose peak had a half-value width of 1° or larger, exhibited a structural change by a thermal treatment, and some of diffraction patterns of the $RE_nF_mC_p$ or $RE_n(F, O, C)_m$ appeared. It was also assumed that a majority of the additive elements listed in Table 1 had no long-period structure in the solutions. The diffraction peak of the $RE_nF_mC_p$ had a narrower half-value width than that of the diffraction peak of the sol or gel. In order to obtain a coating film having a uniform thickness by increasing the fluidity of the solution, it was important to have at least one peak having a half-value width of 1° or larger in the diffraction pattern of the solution. Such a peak having a half-value width of 1° or larger, and the diffraction pattern of $RE_nF_mC_p$ or a peak of an oxygen-fluorine compound may be included in the diffraction pattern of the solution. In the case where only the diffraction pattern of the $RE_nF_mC_p$ or the oxygen-fluorine compound, or where a diffraction pattern having 1° or smaller was observed, mainly in the diffraction pattern of the solution, it was difficult to provide a uniform coating film due to poor fluidity caused by the presence of solid phase, not in a sol or gel form, in the solution.

(1) A block of the NdFeB sintered body (10×10×10 $mm^3$) was immersed in a treating solution for forming a NdF-based coating film, and the solvent methanol was removed at a reduced pressure of 2 to 5 torr from the block.

(2) The operation of Step (1) was repeated 1 to 5 times and the block was heated at a temperature of 400° C. to 1,100° C. for 0.5 to 5 hours.

(3) A pulsed magnetic field of 30 kOe or more was applied to the anisotropic magnet bearing the surface coating film formed in Step (2) in an anisotropic direction.

A demagnetization curve of the magnetized compact was measured by placing the compact between the magnetic poles of a DC M-H loop measurement device such that the magnetization direction of the compact agreed with the direction of the applied magnetic field, and then applying the magnetic field between the magnetic poles. The magnetic pole pieces for the application of the magnetic field to the magnetized compact were made of a FeCo alloy. The values of magnetization were corrected using a pure Ni sample and a pure Fe sample having the same shape.

Figure 2:
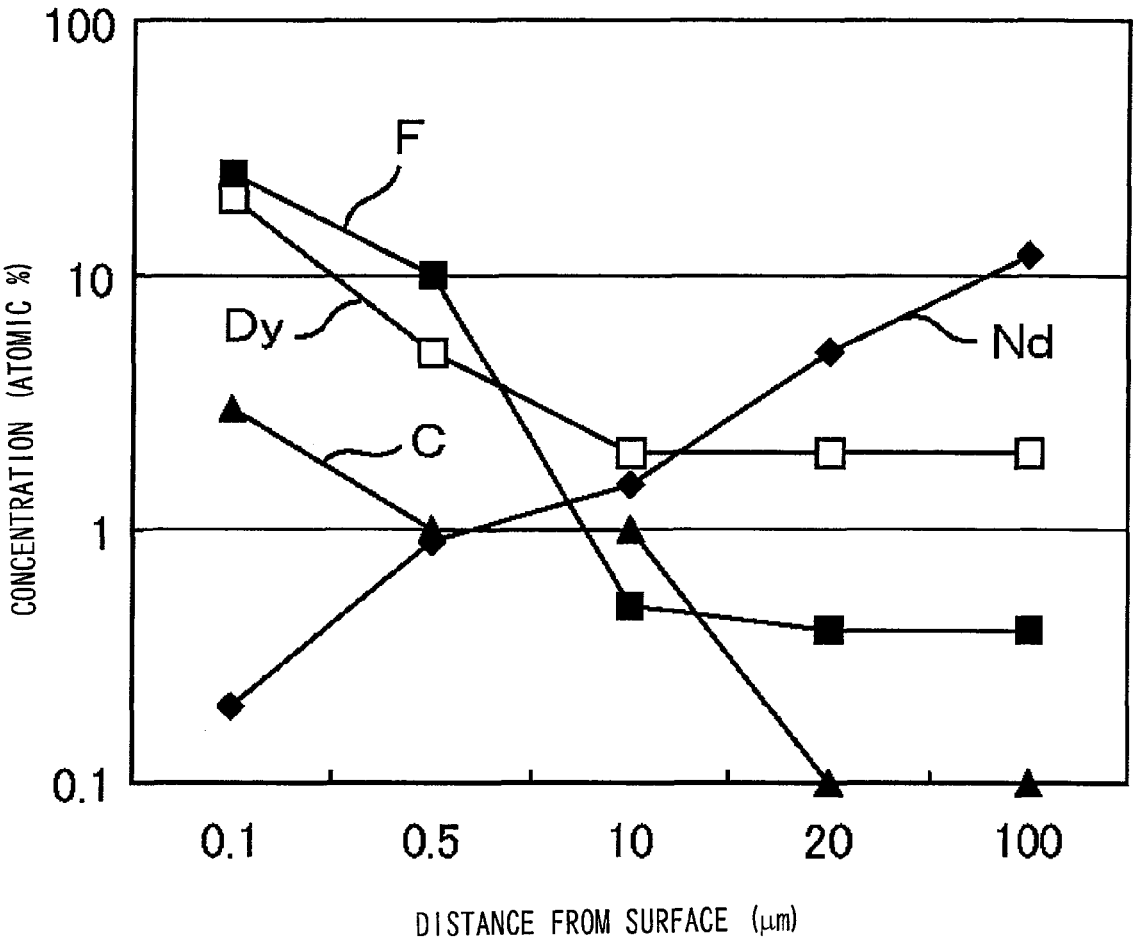
FIG. 2 is a graph that shows one example of the concentration distributions of F, Dy, C, and Nd on a cross-section of the sintered magnet according to an embodiment of the present invention.
Figure 3:
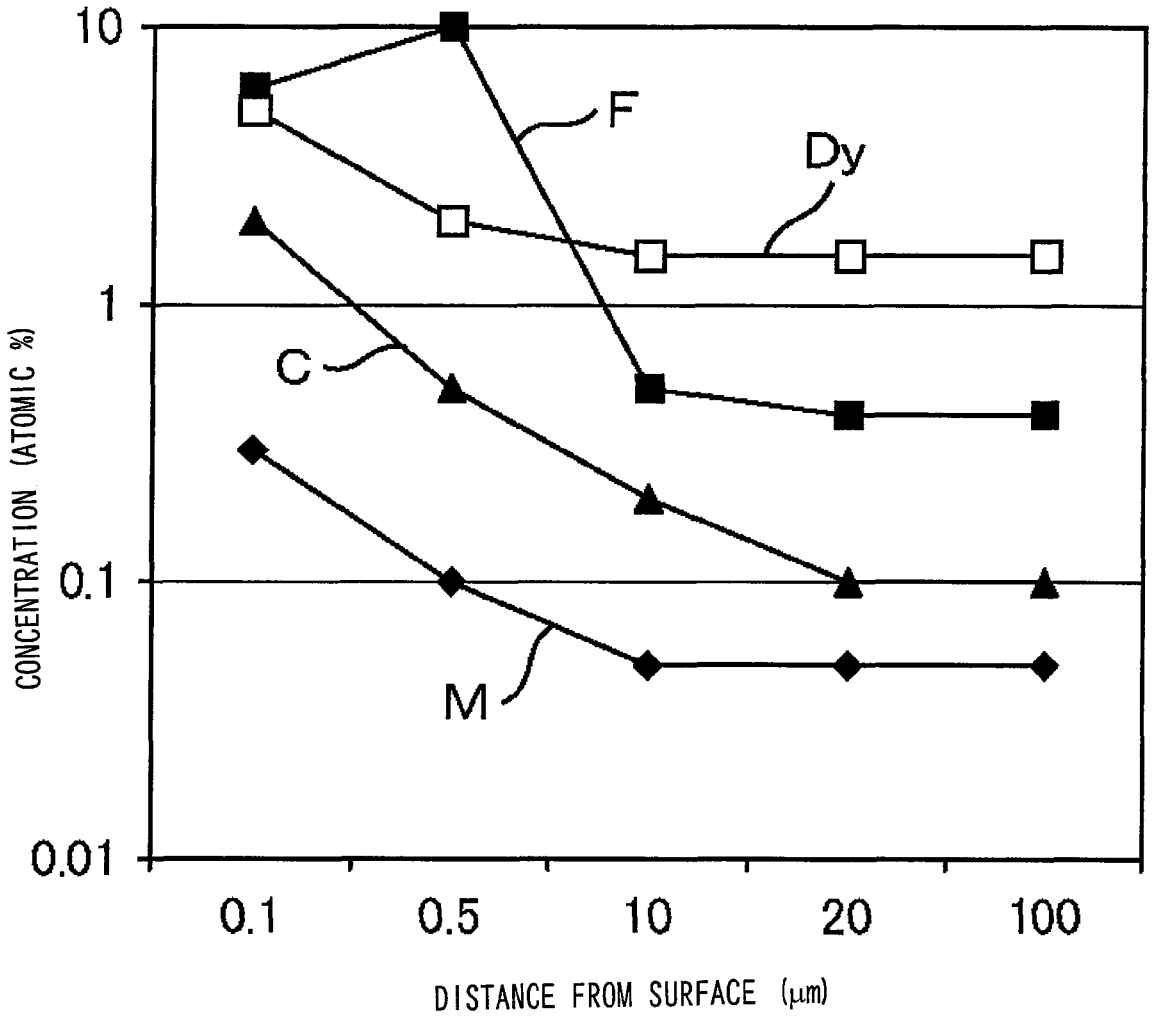
FIGS. 3 to 6 each are a graph that shows one example of the concentration distribution of F, Dy, C, and M on a cross-section of the sintered magnet according to an embodiment of the present invention.
Figure 4:
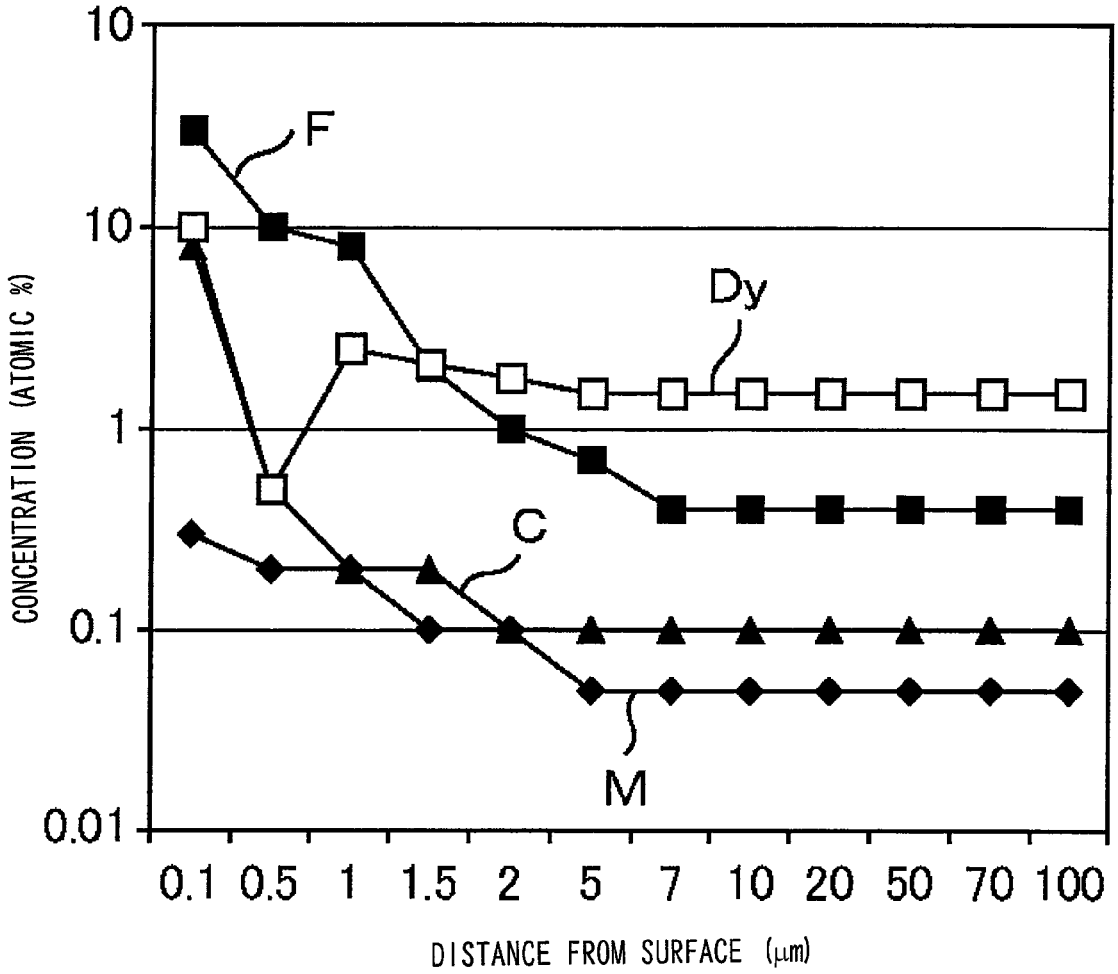
Figure 5:
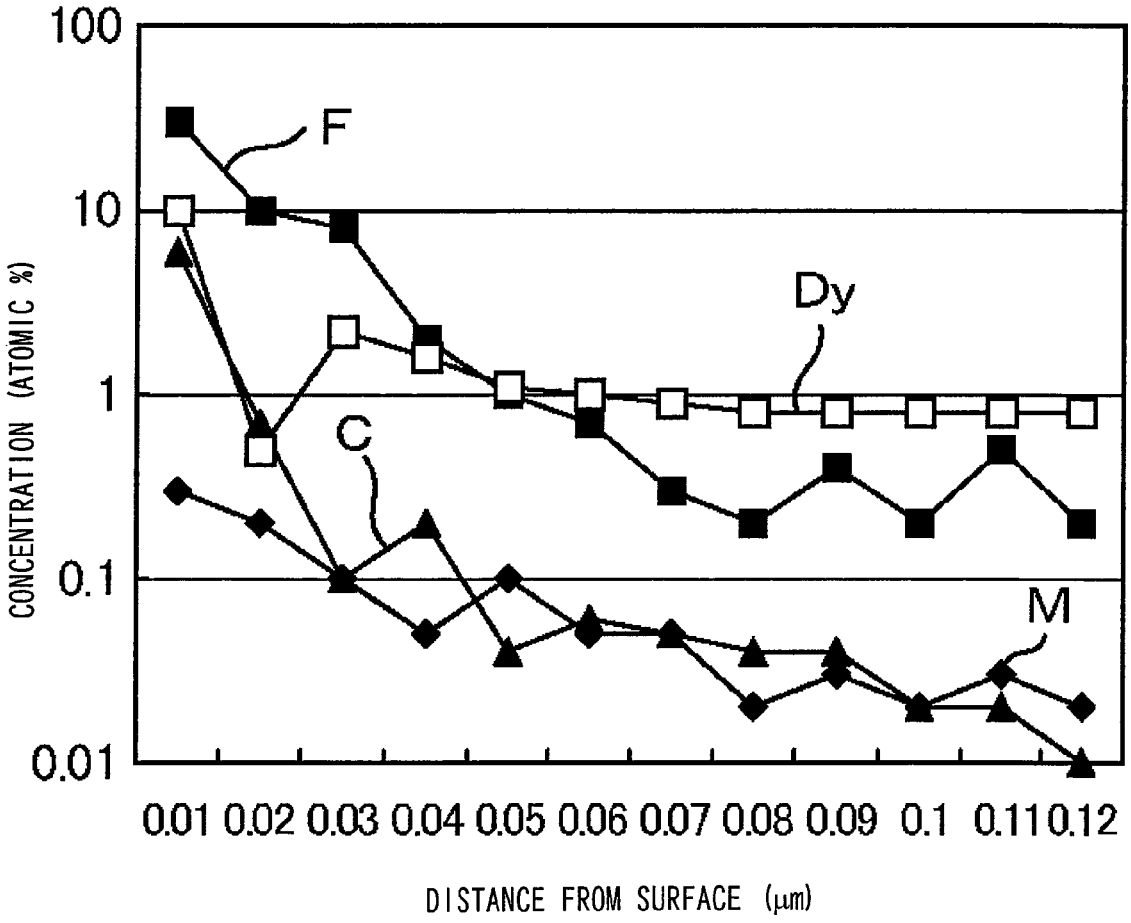
Figure 6:
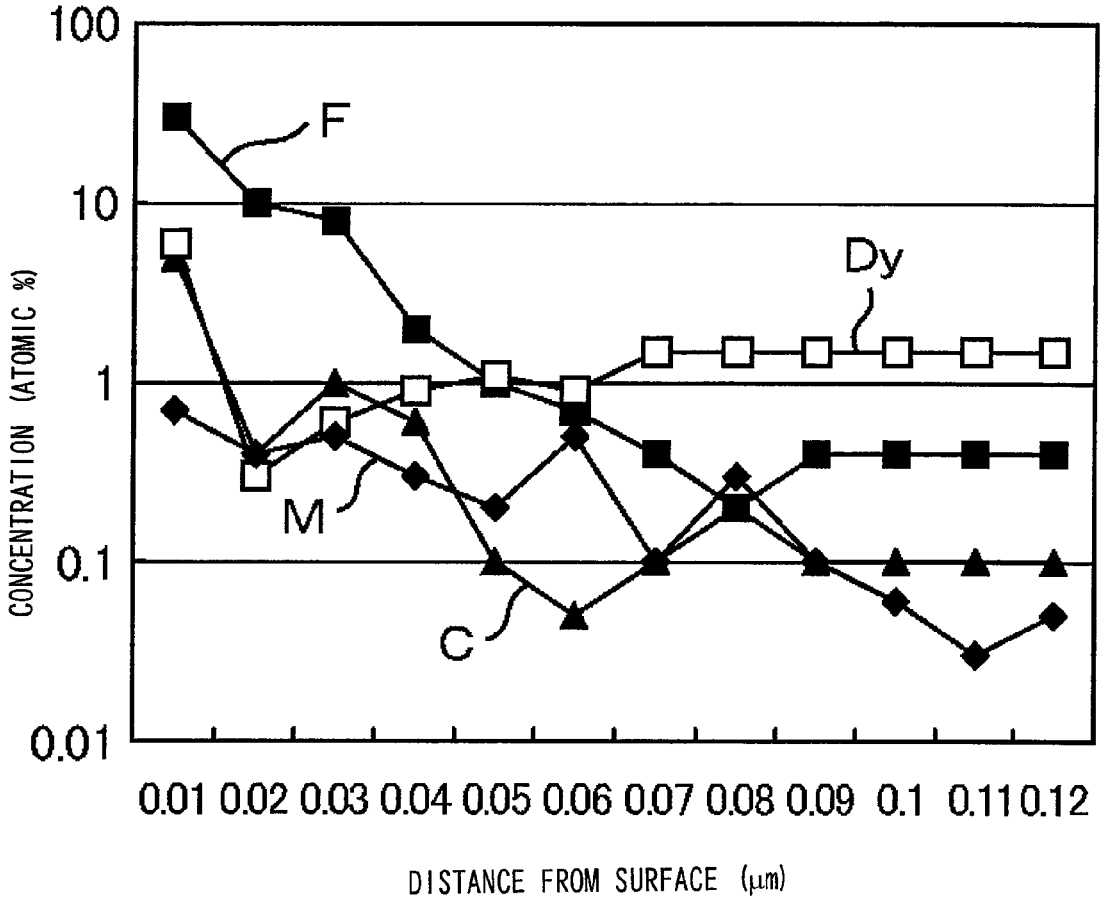

As a result, the block of NdFeB sintered body having the rare earth fluoride coating film formed thereon and sequentially heated acquired an increased coercive force. With no additive element, the coercive forces of sintered magnets having carbon-fluoride or carbon-fluoride oxide compound containing Dy, Nd, La, and Mg segregated therein were increased by 40%, 30%, 25%, and 20%, respectively. In order to further increase the coercive force which had already been increased by coating with the solution having no additive element and then by heating, the additive elements listed in Table 1 were added to the fluorine solutions using an organometal compound. Compared to the coercive force in the case of the solution having no additive element as a reference, the coercive force of the sintered magnet was further increased; thus, it was revealed that these additive elements contributed to the increase of a coercive force. Near the element added to the solution, a short-range structure was observed due to the removal of the solvent. Further heating caused the element to diffuse together with the constituent element of the solution along the grain boundary or various defects of the sintered magnet. The additive elements showed a tendency of segregating together with some of the constituent elements of the solution near the grain boundary. The additive elements listed in Table 1 diffused together with at least one element of fluorine, oxygen, and carbon into the sintered magnet, and some of the elements stayed near the grain boundary. The chemical composition of the sintered magnet that showed a high coercivity was such that the concentration of the element that constituted the carbon fluoride compound solution showed a tendency of being high in the periphery of the magnet and low in a central part of the magnet. This is because when the carbon fluoride compound solution containing the additive element was applied by impregnation on the outer side of the sintered magnet block and dried, a fluoride compound, carbon oxyfluoride compound, carbon fluoride compound, or oxyfluoride compound having a short-range structure grew and at the same time diffusion thereof proceeded along the grain boundary, cracks, or an area around the defects. The concentration distribution of the above-mentioned elements contained in the sintered magnet in a range from the surface toward the inside thereof are shown in FIGS. 1 to 6. FIG. 1 relates to the case where no transition metal element was mixed with the fluoride solution; the content of fluorine was higher than that of Dy on the surface of the sintered magnet, whereas, the content of fluorine was lower than that of Dy inside the sintered magnet. This is because the fluoride compound and the oxyfluoride compound containing Nd and Dy grew near the outermost surface. Also, a concentration gradient of carbon was observed. Carbon fluoride compound or carbon oxyfluoride compound partly grew in an area near the surface of the sintered magnet. The concentration distribution of Nd is shown in FIG. 2, which indicates that the concentration of Nd was lower than that of Dy at the outermost surface of the magnet, whereas beyond 10 μm from the outermost surface of the magnet, the concentration of Nd is higher than that of Dy. When the contents of C and F were below 1 atomic %, the concentration of Nd was higher than that of Dy. FIGS. 3 to 6 are graphs showing concentration distributions of the elements contained in the sintered magnet. In the graphs, M represents a transition metal. M representing elements of Groups from 2 to 16, excluding the rare earth element existing within the sintered magnet before the coating of a solution containing fluorine, and also excluding C and B, showed a tendency of being decreased from the surface of the sintered magnet toward the inside thereof similarly to the tendencies shown by carbon and fluorine. The ratio of Dy, a heave rare earth element, and fluorine was different between the inside and the surface of the sintered magnet and showed a tendency that fluorine was in a larger amount on the surface than on the surface of the sintered magnet. In the concentration distributions of elements shown in FIG. 3, the concentrations of fluorine and Dy on the surface of the sintered magnet were almost equal and the concentration gradient of fluorine was steeper than that of Dy in the inside of the sintered magnet. The concentration distributions of carbon and of transition metal element containing the element listed in Table 1 showed a tendency that a decrease in the concentration was observed from the periphery toward the inside of the sintered magnet. In the concentration distributions of elements shown in FIG. 4, the concentration distribution of Dy showed a minimum, which corresponded to the case where a reaction layer was formed between the fluoride compound and the matrix. In the area of minimum Dy concentration, Nd was detected in large amounts, and as a result of occurrence of exchange reaction between Nd and Dy, the concentration distribution as shown in FIG. 4 was obtained. Decreases in concentrations of the fluorine, carbon, and transition metal element were observed from the periphery toward the inside of the sintered magnet. However, in some cases, the concentration distributions showed maximum or minimum due to influence of the reaction layer. In FIGS. 5 and 6, the concentration of F showed a concave portion and a convex portion in the concentration distribution in the direction of depth, i.e., distance from the surface. Thus, it was considered that a layer in which the concentration of F was high locally grew. In FIG. 6, there was present a position at which a minimum of the concentration of F was observed and also a position at which the concentration of C was maximum. This indicated that a fluoride compound containing a fluoride compound and carbon was localized. The tendencies of the concentration distribution as shown in FIG. 6 were observed not only in the sintered magnet but also in the NdFeB-based magnetic powder or the powder containing a rare earth element, and perceived from FIG. 3 with not only the sintered magnet but also the NdFeB-based magnetic powder, and improvement of the magnetic property were confirmed. The concentration gradients or concentration differences of fluorine and at least one of metal elements of Groups 3 to 11 or Group 2, Groups 12 to 16 including the additive elements listed in Table 1 were observed ranging from the periphery to the inside of the sintered magnetic block. The contents of these elements were almost consistent with the range in which the solution was transmissive to light. In addition, even if the concentration was increased, it was possible to prepare a solution. It was also possible to increase the coercive force of the magnet. Even when an element selected from metal elements of Groups 3 to 11, or an element selected from elements of Group 2, and 12 to 16 except for B (boron) was added to any of a fluoride compound, oxide compound, and oxyfluoride compound including at least one rare earth element in a slurry form, there were confirmed improvements of magnetic properties, such as a high coercive force, compared with the case where no additive element was added. If the concentration of the additive element was increased to 1,000 times the concentration prescribed in Table 1, the structure of the fluoride compound constituting the solution changed, there was observed a tendency that the distribution of the additive element in the solution became nonuniform to inhibit diffusion of the other elements. As a result, it was difficult for the additive element to segregate along the grain boundary and in the inside of the magnetic block. However, a local increase in coercive force was observed. The role of the metal elements of Groups 3 to 11 or of the elements of Groups 2, and 12 to 16 was either of the following roles: 1) to reduce an interface energy by segregating near a grain boundary; and 2) to increase the lattice matching of a grain boundary; 3) to reduce defects at a grain boundary; 4) to promote grain boundary diffusion of the rare earth element and the like; 5) to increase a magnetic anisotropic energy near a grain boundary; 6) to smooth an interface of the magnet with the fluoride compound or the oxyfluoride compound; and 7) to cause a phase containing the additive element having excellent corrosion resistance and having a concentration gradient of fluorine to grow on the outermost surface of the magnet and to increase the stability (adhesion) of the layer as a protective film due to contents of iron and oxygen. The twin crystals were observed in a part of the surface layer. As a result, there was obtained by impregnation coating and diffusion by heat treatment, either any of the following effects were obtained: an increase in coercive force, improvement of squareness of a demagnetization curve, an increase in remanent magnetic flux density, an increase in energy product, an increase in a Curie temperature, a decrease in a magnetization magnetic field, a decrease in dependence of a coercive force and a remanent magnetic flux density on temperature, an improvement of corrosion resistance, an increase in specific resistance, or a decrease in heat demagnetization rate. The concentration distributions of the metal elements of Groups 3 to 11 or of the elements of Groups 2, and 12 to 16 except for B (boron) showed a tendency that their concentrations were decreased on average from the periphery of the sintered magnet toward the inside thereof, the concentration being high at the grain boundary part and the outermost surface of the magnet. The width of the grain boundary tended to be different between the grain boundary triple point and a site remote from the grain boundary triple point, and the width near the with the grain boundary triple point had a larger width than that at the site remote from the grain boundary triple point. An average width of the grain boundary was 0.1 nm to 20 nm, and some of the additive elements segregated within a distance from the surface of 1 to 1,000 times the grain boundary. The segregated additive showed a tendency to have a concentration that was decreased on average from the surface of the magnet toward the inside thereof. Fluorine was present on a part of the grain boundary phase. The additive elements tended to segregate either in the grain boundary phase or at the edge of the grain boundary, or at the periphery (grain boundary side) in the grain as seen from the grain boundary toward the inside of the grain. The additive in the solution of which the effect of improving the magnetic properties of the above-mentioned magnet were confirmed was an element selected from among elements having an atomic number of 18 to 86 including Mg, Al, Si, Ca, Ti, V, Cr, Mn, Fe, Co, Ni, Cu, Zn, Ga, Ge, Sr, Zr, Nb, Mo, Pd, Ag, In, Sn, Hf, Ta, W, Ir Pt, Au, Pb, and Bi listed in Table 1 and all the transition metal elements. At least one of these elements and fluorine showed concentration gradients, respectively, in the sintered magnet from the periphery of the magnet toward the inside thereof on average. The concentration gradients or the concentration differences of the metal elements of Groups 3 to 11 or the additive element of Groups 2, and 12 to 16 except for B (boron) near the grain boundary and in the grain changed on average from the periphery of the magnet toward the central part thereof, tending to be small with approaching the center of the magnet. When sufficient diffusion of such an element occurred, there was observed a concentration difference of the additive element accompanying the segregation of the additive element at an area near the grain boundary containing fluorine. The additive elements were applied to the magnet by treating it with a solution thereof and then heating for diffusion. For this reason, unlike the compositional distribution of the elements added to the sintered magnet in advance, the above-mentioned additive elements occurred in high concentrations near the grain boundary where fluorine was segregated whereas segregation of the elements added to the sintered magnet in advance was observed near the grain boundary where segregation of a small amount of fluorine was observed. Thus, an average concentration gradient appeared from the outermost surface of the magnet block toward the inside thereof. Even when the additive elements were present in low concentrations in the solution, there was observed a concentration difference between the outermost surface of the magnet and the central part thereof. This was confirmed as a concentration gradient or a concentration difference between the grain boundary and the inside of the grain. Thus, when the solution to which the additive element had been added was applied to a magnet block by impregnation and the impregnated magnet block was heated to improve the magnetic properties of the resultant sintered magnet, the magnet had the following features. 1) The concentration gradient or the average concentration difference of elements having an atomic number of 18 to 86 including the element listed in Table 1 or the transition metal elements was observed along a direction of from the outermost surface of the sintered magnet that contained a reaction layer between the sintered magnet and a layer containing fluorine toward the inside of the sintered magnet; 2) In most parts, the segregation near the grain boundary of one or more of the elements having an atomic number of 18 to 86 including the elements listed in Table 1 or the transition elements occurred as accompanied by at least one of fluorine, carbon, and oxygen; and 3) The concentration of fluorine was high in the grain boundary phase whereas it is low outside the grain boundary phase (peripheral part of crystal grain). Within an area 1,000 times the width of the grain boundary where the concentration difference of fluorine was observed, segregation of the element listed in Table 1 or the element having an atomic number of 18 to 86 was observed. In addition, an average concentration gradient or concentration difference was observed from the surface of the magnetic block toward the inside thereof. 4) The concentrations of fluorine and the additive element were the highest in the outermost periphery of a sintered magnet block, or magnet powder, or ferromagnetic power, and concentration gradient or concentration difference of the additive element was observed from the periphery of the magnetic material part toward the inside thereof. 5) A layer having a thickness of 1 nm to 10,000 nm containing fluorine, carbon, oxygen, iron, and the element listed in Table 1 or the element having an atomic number of 18 to 86 was formed on the outermost surface of the magnetic material in a coverage of 10% or more, preferably 50% or more. This contributed to improvement of corrosion resistance and recovery of the magnetic properties of the layer damaged by the treatment and so on. 6) At least one of the elements constituting a solution containing the additive element listed in Table 1 and the element having an atomic number of 18 to 86 had a concentration gradient from the surface toward the inside of the magnet. The concentration of fluorine was maximal in an area near the interface between the magnet and the fluorine-containing film that grew from the solution or outer side of the interface as seen from the magnet. The fluoride compound near the interface contained oxygen or carbon, or the element having an atomic number of 18 to 86. This contributed to any of high corrosion resistance, high electric resistivity, or high magnetic properties. In the fluorine-containing film, at least one element of the additive elements listed in Table 1 and the elements having an atomic number of 18 to 86 was detected. The above-mentioned additive elements were contained in higher concentrations near the impregnation paths of fluorine in the magnet than in other portions, and there was observed any one of the effects: an increase in coercive force, an improvement of squareness of demagnetization curve, an increase in remanent magnetic flux density, an increase in energy product, an increase in a Curie temperature, a decrease in a magnetization field, a decrease in dependence of a coercive force and a remanent magnetic flux density on temperature, an improvement of corrosion resistance, an increase in specific resistivity, a decrease in a heat demagnetization rate, and an increase in magnetic specific heat. The concentration difference of the above-mentioned additive element or elements could be confirmed by analyzing the crystal grain of the sintering block by EDX (energy dispersive x-ray) profile of a transmission electron microscope, EPMA (electron probe micro-analysis) and Auger analysis, or the like. Segregation of the element having an atomic number of 18 to 86 added to the solution near a fluorine atom (within 5,000 nm, preferably 1,000 nm from the position at which the fluorine atom segregated) was confirmed by analyses by EDX of a transmission electron microscope and EELS (electron energy-loss spectroscopy). Ratios of the additive elements segregating near fluorine atoms to the additive elements existing at positions at a distance of 2,000 nm or longer from the position at which the fluorine atom segregated was 1.01 to 1,000, preferably 2 or more at a position distant 100 μm from the surface of the magnet. The above-mentioned ratio was 2 or more on the surface of the magnet. The additive elements existed both in a state where they segregated continuously and in a state where they segregated discontinuously along the grain boundary, and did not always segregate all over the grain boundary. Their occurrence tended to be discontinuous on the side of the center of the magnet. Moreover, a part of the additive element did not segregate but was uniformly mixed with the matrix. The additive elements having an atomic number of 18 to 86 showed a tendency that the ratio of the elements that diffused in the matrix from the surface of the sintered magnet toward the inside thereof or the concentration of the elements that segregated near the position at which fluorine segregated. Due to this concentration distribution, the magnet had a higher coercive force near the surface than in the inside thereof. As for the effect of improving the magnetic properties, even when a film containing fluorine and the additive element was formed on the surface of not only sintered magnet block but also NdFeB-based magnet powder, SmCo-based magnet powder, or Fe-based magnet powder using the solutions listed in Table 1, the effects of improvement of ferromagnetic properties and an increase in electric resistivity of the magnet powder, and so on were obtained. Furthermore, it was possible to prepare a sintered magnet by impregnating a preliminary compact formed after preliminary molding a NdFeB powder formed in a magnetic field into any of a solution containing the metal elements of Groups 3 to 11 or the elements of Groups 2 and 12 to 16 except for C and B to provide a film containing an additive element and fluorine formed in a part of the surface of the magnetic powder, and then sintering the preliminary compact. It was also possible to prepare a sintered magnet by preliminarily molding, in a magnetic field, a mixture of a NdFeB-based powder having the surface treated with a solution containing the metal element of Groups 3 to 11 or the elements of Groups 2 and 12 to 16 except for C and B and an untreated NdFeB-based powder and sintering the preliminary compact. Although having averagely uniform distributions of concentrations of the solution constituent elements, such as fluorine and additive elements included in the solution, such a sintered magnet had improved magnetic properties due to the averagely high concentration of the metal elements of Groups 3 to 11 or the elements of Groups 2 and 12 to 16 except for C and B near the diffusion path of fluorine atom. A fluorine-containing grain boundary phase formed from a solution containing the metal elements of Groups 3 to 11 or the elements of Groups 2 and 12 to 16 except for C and B had an average concentration of fluorine from 0.1 to 60 atomic %, preferably 1 to 20 atomic %, in the segregating region. The grain boundary phase can be non-magnetic, ferromagnetic, or antiferromagnetic, depending on concentration of additive element. Hence, it is possible to control magnetic properties by strengthen and weaken a magnetic bond between the ferromagnetic grain and the grain. It was possible to prepare a hard magnetic material from a solution by using the fluoride compound solution to which an organometal compound was added. Thus, there was obtained a magnetic material having a composition of 1 to 20 atomic % of a rare earth element, 50 to 95 atomic % of Fe, Co, Ni, Mn, and Cr, and 0.5 to 15 atomic % of fluorine and having a coercive force of 0.5 MA/m at 20° C. Even if the magnetic material having the above-mentioned composition contained some of elements selected from carbon, oxygen, metal elements of Groups 3 to 11, and elements of Groups 2 and 12 to 16 except for C and B, the sintered magnet had a coercive force of 0.5 MA/m at 20° C. Therefore, such magnetic material was applicable to various magnetic circuits. Since the above-mentioned magnetic material was used in the form of solutions, processing steps were not always necessary.

Ninth Embodiment

A fluoride compound $DyF_3$ cluster solution which can grow up to a rare earth fluoride compound at a temperature of 100° C. or more is applied by impregnation under vacuum over the surface of a NdFeB-based compression molded body which includes $Nd_2Fe_{14}B$ as a main phase. The fluoride compound cluster after the coating film has an average film thickness of from 1 nm to 10 nm. Such a cluster does not have a crystal structure of a bulk fluoride compound, and instead fluorine and the rare earth element, Dy, are coupled having a periodic structure. The NdFeB-based compression molded body is composed of magnetic particles that have a crystal grain size of 1 μm to 20 μm on average and include $Nd_2Fe_{14}B$ as a main phase. An $Nd_2Fe_{14}B$ magnet sintered at 900° C. after the impregnation contains Dy segregated near the crystal grain boundary, and an increase in a coercive force, an improvement of squareness of a demagnetization curve, an increase in resistance on the surface of the magnet or near the grain boundary, an increased Curie temperature due to the fluoride compound, an increase in mechanical strength, an increase in corrosion resistance, a decrease in usage of the rare earth elements, and a decrease in a magnetic field for magnetization, and so on can be confirmed. The $DyF_3$ rare earth fluoride compound clusters grow to particles having a particle size of 10 nm or less and 1 nm or more during the steps of applying it by impregnation and drying, and the precursor or some of the fluoride compound clusters react with diffuse into the grain boundaries and the surface of the sintered magnet by further heating. Since the particles of the fluoride compound after the coating and drying have not passed the grinding process, they have surfaces without protrusions and acute angles it the temperature is within a range in which the particles do not coalesce with each other. According to observation of the particles using a transmission electron microscope, they appear to be rounded oval or round shapes and no cracks are observed in the grain or on the surface of the grain. No discontinuous uneven is observed in the contour. These particles coalesce with each other and grow on the surface of the sintered magnet and diffuse along the grain boundaries of the sintered magnet or mutually diffuse with the elements included in the sintered magnet by heating. Moreover, since the cluster-shaped rare earth fluoride compound is coated over the surface of the magnetic particles along the spaces or gaps of a preformed body, $DyF_3$ is formed on almost the entire surface of the magnetic particles facing the spaces or gaps in the inside of the preformed body, and after the coating and drying, a part of the area having a high rare earth element concentration is fluorinated at a part of the surface of the crystal grains of the sintered magnet. This fluorinated phase or fluorinated phase including oxygen grows partially matched to the matrix; the fluoride compound phase or oxyfluoride compound phase grows outside as seen from the matrix of such a fluorinated phase or fluorinated phase including oxygen phase lattice matched thereto; and Dy is segregated in the fluorinated phase, the fluoride compound phase, or the oxyfluoride compound phase. This results in an increase in a coercive force.

The ribbon-shaped part where Dy is concentrated along the grain boundaries has a width preferably in the range of from 0.1 nm to 100 nm, and in this width range, a sintered magnet that satisfy a high remanent magnetic flux density and a high coercive force can be obtained. When Dy is concentrated along the grain boundary by the above-mentioned method using a precursor of $DyF_{2-3}$, the obtained sintered magnet has magnetic properties: a remanent magnetic flux density of 1.0 to 1.6 T and a coercive force of 20 to 50 kOe. As a result, the concentration of Dy contained in a rare earth element sintered magnet that has equivalent magnetic properties can be decreased compared to the case where conventional Dy-added NdFeB-based magnetic particles are utilized. When such a $DyF_x$ (X=2 to 3) solution was impregnated under vacuum to a preformed body prepared by compression molding $Nd_2Fe_{14}B$ powder in a magnetic field and the impregnated preformed body is sintered, the obtained sintered magnet has the following structural features: 1) the average film thickness of a film of the oxyfluoride Dy compound is different between the direction of anisotropy and a direction perpendicular thereto. When the impregnation direction is parallel to the direction of anisotropy, the average film thickness of the oxyfluoride compound is as thick as about 10 nm in a direction parallel to the direction of anisotropy whereas about 2 to 7 nm in a direction perpendicular to the direction of anisotropy. In this case, the concentrations of Nd and oxygen of the oxyfluoride compound are high and the continuity of the stratified oxyfluoride Dy compound is high in a direction parallel to the direction of anisotropy. Moreover, the outermost surface of the sintered magnet is covered with an oxyfluoride compound (Nd, Dy) (O, F) or a fluoride compound (Nd, Dy) $F_x$ (x=1 to 3) having an average crystal particle size larger than that of the oxyfluoride compound (Nd, Dy) (O, F) inside and having oxygen concentration higher than fluorine concentration, and the interface between $Nd_2Fe_{14}B$ and the oxyfluoride compound (Nd, Dy) (O, F) in the sintered magnet has unevenness of 10 nm or more and 10 μm or less.

Tenth Embodiment

Figure 7:
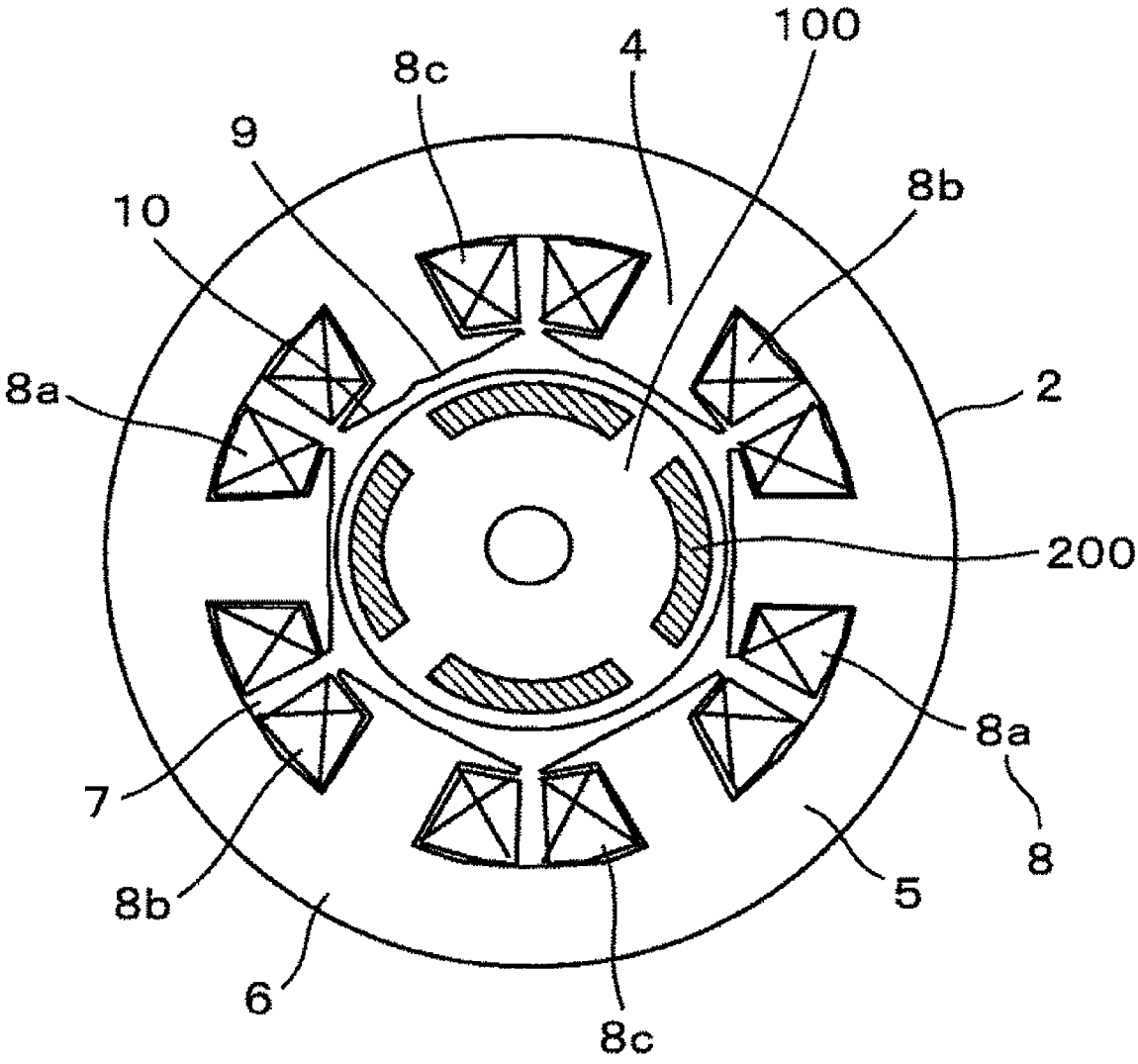
FIGS. 7 to 9 each are schematic diagram showing an example of a cross-section of the magnet motor according to an embodiment of the present invention.
Figure 8:
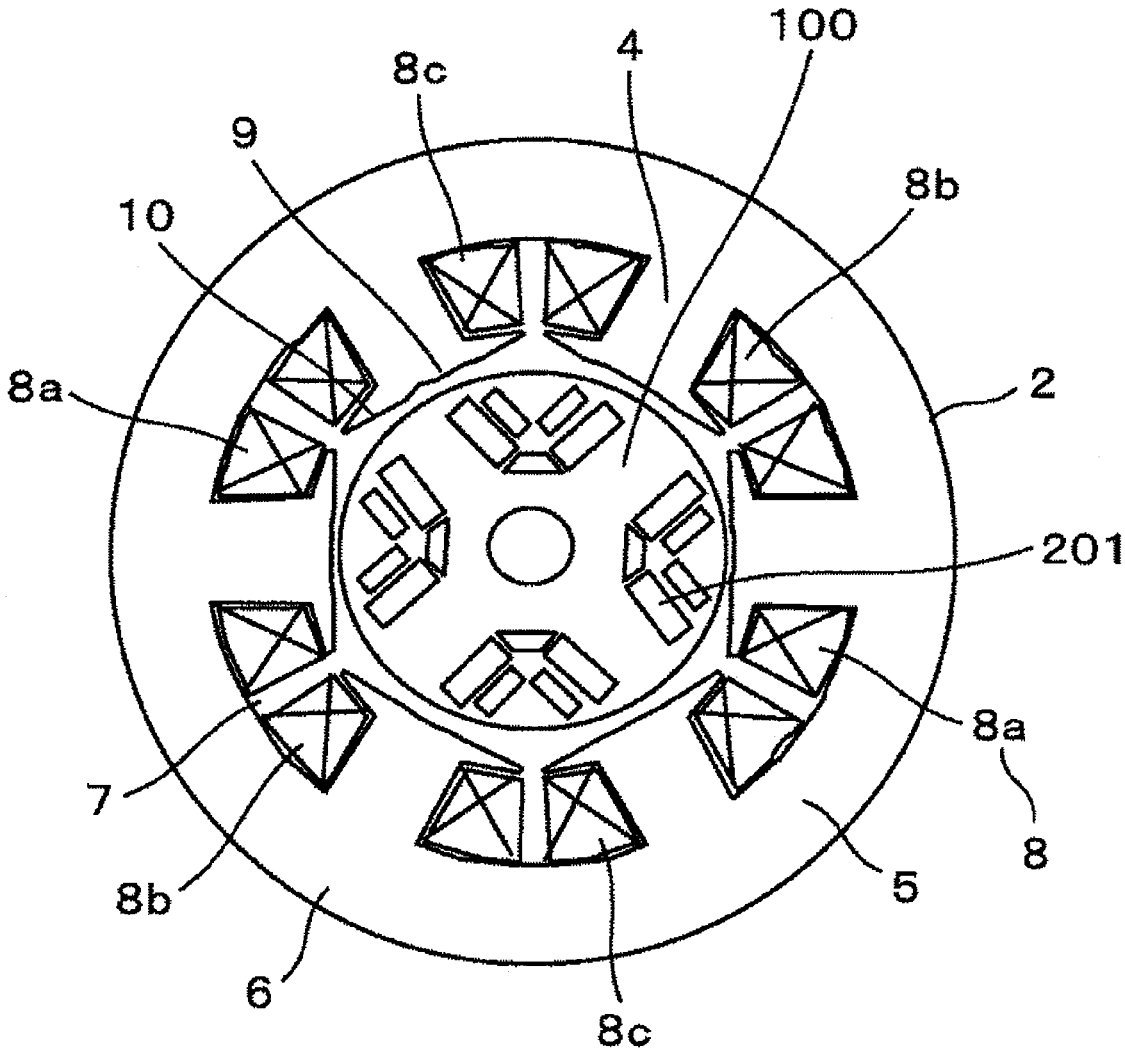

Referring to FIG. 7, a motor stator 2 includes a stator iron core 6 having teeth 4 and a core back 5, and an armature winding wire 8 (three-phase winding wires consisting of a U-phase winding wire 8*a*, a V-phase winding wire 8*b*, and a W-phase winding wire 8*c*) in a slot 7 provided between teeth 4, with the armature wiring 8 being wound in a concentrated pattern to surround the teeth 4 for a motor. Since the motor has a 4-pole-6-slot structure, the slot pitch is 120 degrees in terms of electrical angle. A rotor is inserted into a shaft hole 9 or a rotor hole 10, and a sintered magnet 200 of which the concentration gradient of fluorine is any one of those shown in FIGS. 1 to 6 is arranged on the inner periphery side of a rotor shaft 100. The sintered magnet has an arcuate shape and retains thermal resistance due to segregation of a heavy rare earth element such as Dy on a part thereof. It can be used for the production of a motor used at a temperature ranging from 100° C. to 250° C. FIG. 8 shows a cross-section of a rotor in which instead of arcuate magnets, there is formed a plurality of magnet insertion sections and sintered magnets 201 are arranged in the respective magnet insertion sections. Referring to FIG. 8, the motor stator 2 has the stator iron core 6 having the teeth 4 and the core back 5, and the armature winding wire 8 (three-phase winding wires consisting of the U-phase winding wire 8*a*, the V-phase winding wire 8*b*, and the W-phase winding wire 8*c*) in a slot 7 provided between teeth 4, with the armature wiring 8 being wound in a concentrated pattern to surround the teeth 4 for a motor. The rotor is inserted into the shaft hole 9 or the rotor hole 10, and the sintered magnet 200 of which the concentration gradient of fluorine is any one of those shown in FIGS. 1 to 6 is arranged on the inner periphery side of the rotor shaft 100. The sintered magnet has a cubic shape with corners being cut off. It retains a coercive force, thermal resistance, and corrosion resistance due to segregation of a heavy rare earth element such as Dy in a part of the grain boundary. This arrangement of magnets generates reluctance torque and segregation of fluorine is continuously formed in the grain boundary of the sintered magnets 201, resulting in an increase in a coercive force and an increase in specific resistivity. Accordingly, the motor loss can be reduced. Segregation of Dy results in a decrease in the usage of Dy as compared to the case where no segregation of Dy occurs and the remanent magnetic flux density of the magnet increases. This leads to an improvement of torque.

Eleventh Embodiment

Figure 9:
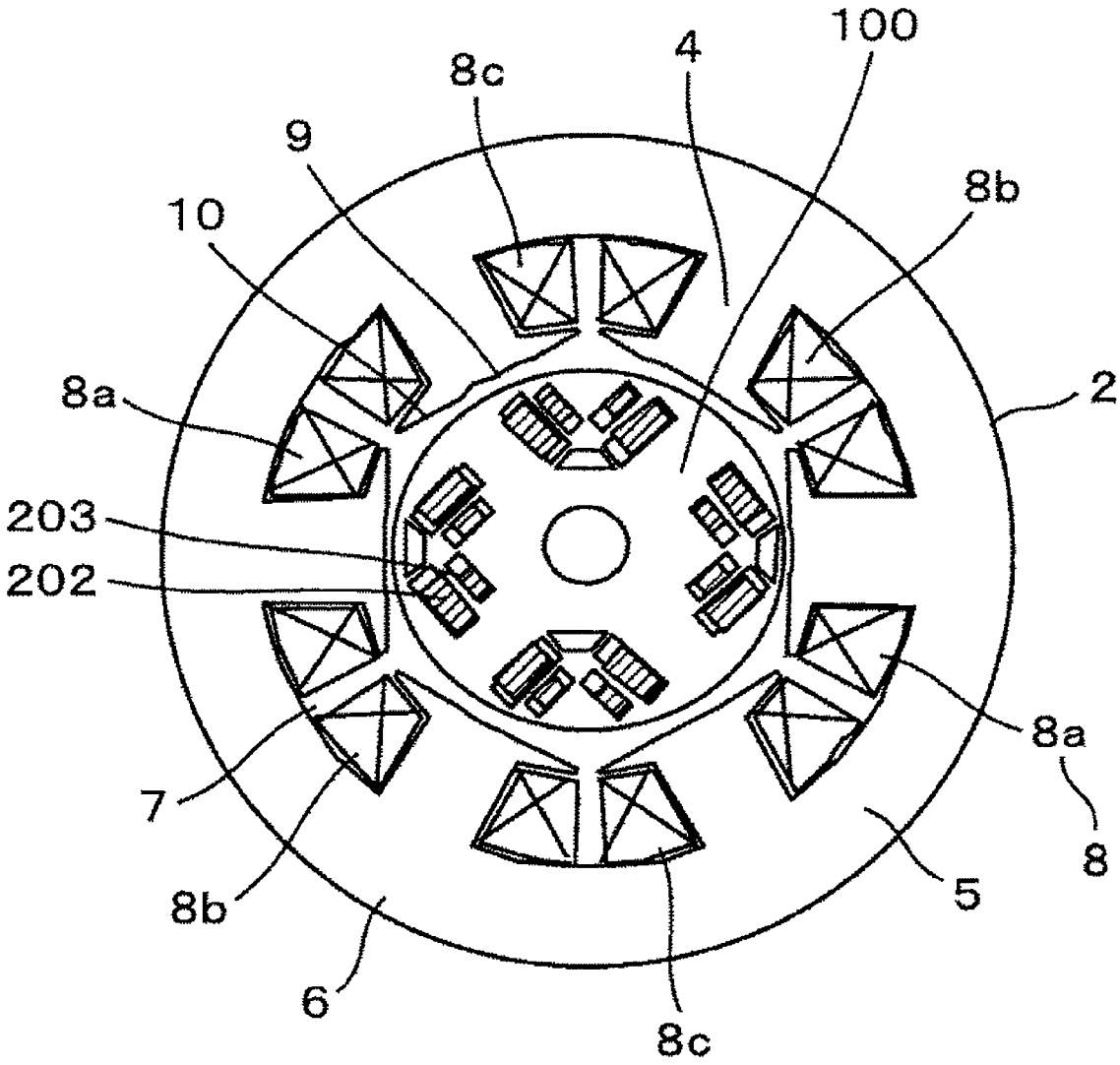
Figure 10:
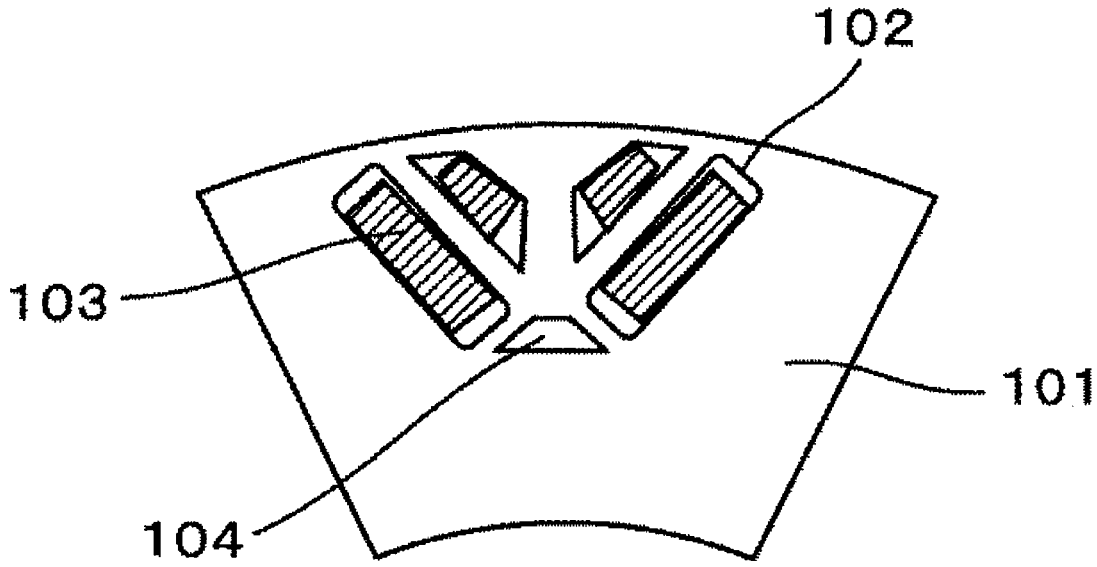
FIGS. 10 to 13 each are a typical cross-section that shows one magnet disposition of rotator example.

Referring FIG. 9, a silicon steel sheet (or electromagnetic steel sheet) is used for the stator, and a laminate punched out of silicon steel sheets is used for the stator iron core 6. Outer side sintered magnets 202 and inner side sintered magnets 203 are disposed in the rotor. The sintered magnets 202,203 are each an anisotropic magnet that has been imparted with anisotropy in a magnetic field. The fluorine content of the entire magnet of outer side sintered magnet 202 is higher than that of the inner side sintered magnet 203. An increased content of fluorine provides an increased concentration of fluorine in the grain boundary part, which promotes segregation of rare earth elements to the vicinity of the grain boundary. The segregation of the rare earth elements makes a high coercivity and a high remanent magnetic flux density compatible, so that the temperature characteristics of the motor can be retained ever at the higher temperature side. Both the sintered magnets 201,203 can be fabricated by using the process of treatment with a fluoride solution, and it is also possible to fabricate sintered magnets having a 3-dimensional shape. When the concentration of fluorine is higher than that of the rare earth element in terms of atomic ratio in the grain boundary, eddy current loss of the sintered magnet is decreased, which contributes to a decrease in motor loss. It is effective to arrange sintered magnets containing a large amount of fluorine on the outer periphery side of the rotor since the magnitude of the magnetic field in a direction opposite to the magnetization direction of the magnet becomes large on the outer periphery side of the rotor.

Twelfth Embodiment

Figure 11:
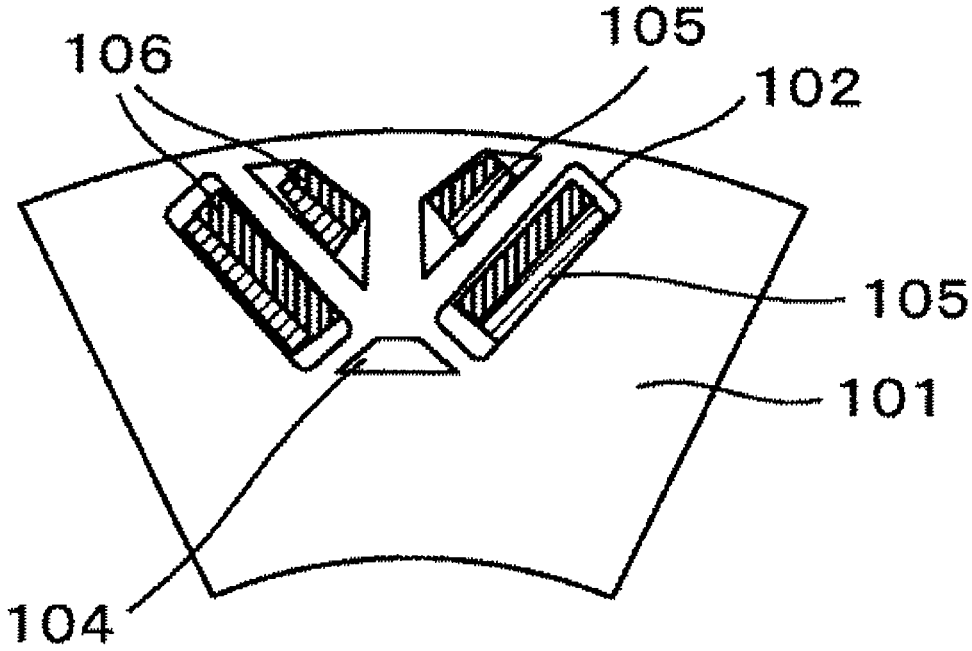
Figure 12:
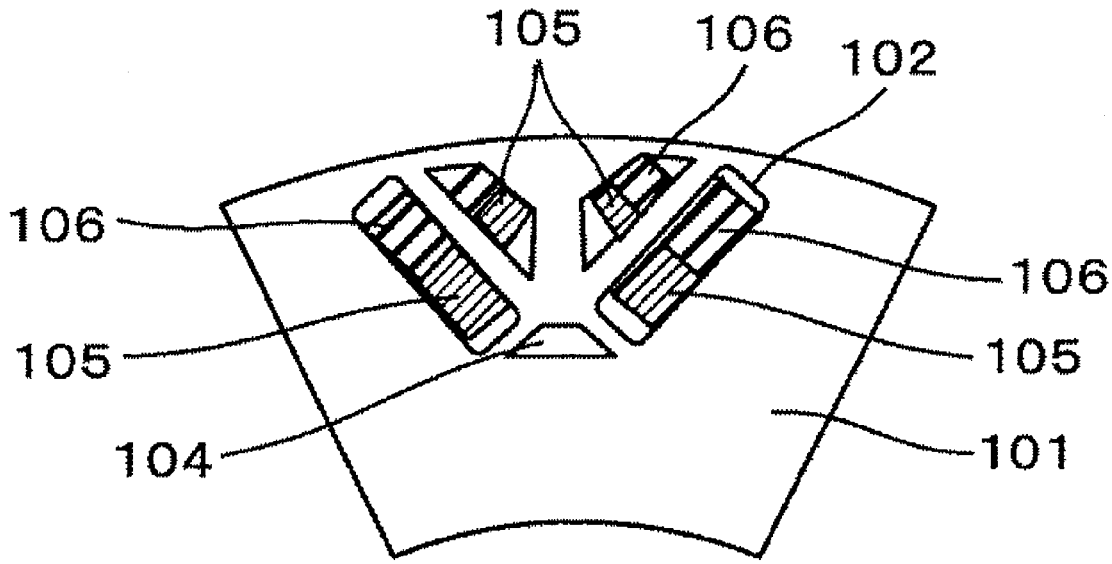

FIGS. 10 to 13 each show a cross-sectional configuration of the rotator for each pole. These figures each show the rotor 101 that uses reluctance torque and magnet torque. The rotors 101 each are provided with a space 104 in which no magnet is arranged for reluctance torque. A hole is formed in the laminated steel sheets by punching or the like method in advance in a position in which the magnet is to be inserted. This hole serves as the magnet insertion hole 102. The magnet rotor can be fabricated by inserting the sintered magnet 103 in the magnet insertion hole 102. The sintered magnet 103 is a magnet that contains fluorine that has segregated in a part of the grain boundary of the sintered magnet and has magnetic properties of a coercive force of 10 kOe or more and a remanent magnetic flux density 0.6 to 1.5 T. FIG. 11 shows a magnet fabricated by impregnating a preformed compact with a fluorine containing impregnation material and then sintering the impregnated compact and arranged in the magnet insertion hole 102 in the axial direction of the rotor. Such a sintered magnet can be fabricated by diffusing coating a solution containing fluorine on one side of the magnet and then allowing the fluorine to diffuse. A ratio of fluorine concentrations (maximum concentration/minimum concentration ratio) is 2 to 10,000 on average. By causing a metal element to segregate together with the fluorine, the sintered magnet 106 having a higher fluorine concentration has an increased coercive force. The above-mentioned sintered magnet includes a material having a high coercive force and a material having a high residual reflux density and as a result the rotor can achieve a high resistance to demagnetization for an inverse magnetic field upon operation and a high torque characteristic. Therefore, the sintered magnet is suitable for an HEV (hybrid electric vehicle) motor. Referring to FIG. 12, there are arranged sintered magnets having different fluorine concentrations, i.e., a sintered magnet 106 having a higher fluorine concentration and a sintered magnet 105 having a lower fluorine content in the magnet insertion hole 102 in a direction perpendicular to the axial direction of the rotor. The sintered magnet is fabricated by impregnating preformed compacts prepared using the same mold with a solution containing fluorine from a part of the surface, and drying and sintering the impregnated and non-impregnated compacts such that the impregnated sintered magnet 106 being located on the outer side of the rotor and the non-impregnated sintered magnet 105 being located on the inner side of the rotor. This rotator is high in demagnetization resistance to the inverse magnetic field upon operation and can achieve high torque characteristics, so that it is suitable for an HEV motor and the like.

Figure 13:
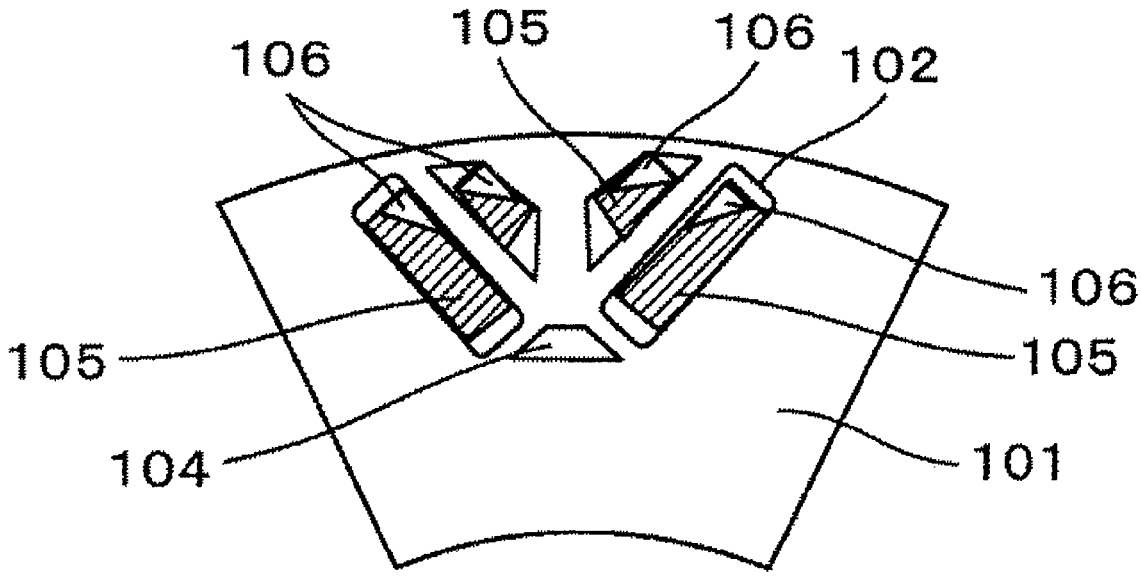

FIG. 13 shows a sintered magnet prepared by impregnating a molded body imparted with anisotropy at corners thereof on the outer side of the molded body and then sintering the impregnated molded body arranged in a direction perpendicular to the axial direction of the rotor in the magnet insertion hole 102. The sintered magnet is fabricated by impregnating preformed compacts prepared using the same mold with a solution containing fluorine from a part of the surface, and drying and sintering the impregnated compacts such that the impregnated sintered magnet 106 being located on the outer side of the rotor and the non-impregnated sintered magnet 105 occupying the rest. This rotator is high in demagnetization resistance to the inverse magnetic field upon operation, can be fabricated using a small amount the fluorine-containing impregnation solution and hence achieve low cost. Therefore it is suitable for an HEV motor and the like. Note that when the solution containing fluorine is impregnated from a corner of the magnet, a solution that also contains fluorine to enable the fluorine and Dy to segregate near the grain boundary of the sintered magnet to increase the coercive force of the sintered magnet. Moreover, by applying the solution to a part of the surface of the magnet by immersion of the magnet or by coating on the magnet, it is possible to make a desired portion (circular, arcuate, rectangular, etc.) to have a high coercive force. Therefore, it is possible to make a part of the corners of the magnet to have a high coercive force as shown in FIG. 13 to increase demagnetization resistance.

The above described embodiments are examples and various modifications can be made without departing from the scope of the invention.

What is claimed is:

1. A rotating machine comprising a sintered magnet, wherein the sintered magnet includes crystal grains of a ferromagnetic material consisting mainly of iron, and a layer of a fluoride compound or a layer of an oxyfluoride compound, containing at least one element selected from the group consisting of an alkali metal element, an alkali earth metal element, and a rare earth element, the layer of the fluoride compound or the layer of the oxyfluoride compound being formed inside some of the crystal grains or in a part of a grain boundary part, a fluoride compound or oxyfluoride compound containing carbon in a stratified form is formed on an outermost surface of the sintered magnet, the layer of fluoride compound or the layer of oxyfluoride compound formed inside some of the crystal grains or in the part of the grain boundary contains at least one light rare earth element and at least one heavy rare earth element, and the at least one heavy rare earth element has a concentration lower than that of the light rare earth element, and the layer of the fluoride compound or the layer of the oxyfluoride compound formed in some of the crystal grains or in the part of the grain boundary has a difference in continuity thereof between a direction parallel to a direction of anisotropy and a direction perpendicular to the direction of anisotropy.

2. A rotating machine according to claim 1, wherein the fluoride compound or the oxyfluoride compound that are formed on the outermost surface of the sintered magnet has a mean crystal particle size larger than that of the oxyfluoride compound or the fluoride compound in the inside of the crystal particles.

3. A rotating machine according to claim 1, wherein the layer of the fluoride compound or the layer of the oxyfluoride compound has a mean volume that is different between a direction parallel to a direction of anisotropy of the sintered magnet and a direction perpendicular to the direction of anisotropy of the sintered magnet.

4. A rotating machine according to claim 1, wherein the layer of the oxyfluoride compound or the layer of the fluoride compound has a difference in at least one of concentration and film thickness formed within some of the crystal grains or in the portion of the grain boundary between a direction parallel to a direction of anisotropy and a direction perpendicular to the direction of anisotropy.

5. A rotating machine according to claim 1, wherein a concentration of fluorine is higher than that of oxygen in the fluoride compound or the oxyfluoride compound formed on the outermost surface of the sintered magnet; and an interface between a main phase of the sintered magnet and the oxyfluoride compound has unevenness of 10 nm or larger and 10 μm or smaller.

6. A rotating machine according to claim 1, wherein oxides are formed near the grain boundary of the fluoride compound or the oxyfluoride compound on the outermost surface of the sintered magnet.

7. A rotating machine according to claim 1, wherein the sintered magnet is formed by impregnation of a solution that is transmissive to light into a low density compact with gaps, the transmissive solution including the fluoride compound, the oxyfluoride compound, or the fluoride compound or oxyfluoride compound containing carbon.

8. A rotating machine comprising:

a stator having an iron core and a stator winding wire;

a rotor disposed rotatably with a space from the stator;

the rotor having formed therein a plurality of slots, each of the slots having embedded therein at least one permanent magnet;

each of the permanent magnets constituting a field pole, wherein the permanent magnet includes crystal grains of a ferromagnetic material consisting mainly of iron, and a layer of a fluoride compound or a layer of an oxyfluoride compound, containing at least one element selected from the group consisting of an alkali metal element, an alkali earth metal element, and a rare earth element, the layer of the fluoride compound or the layer of the oxyfluoride compound being formed inside some of the crystal grains or in a part of a grain boundary part, a fluoride compound or oxyfluoride compound containing carbon in a stratified form is formed on an outermost surface of the sintered magnet, the layer of fluoride compound or the layer of oxyfluoride compound formed in some of the crystal grains or in the part of the grain boundary contains at least one light rare earth element and at least one heavy rare earth element, the at least one heavy rare earth element has a concentration lower than that of the light rare earth element, and the layer of the fluoride compound or the layer of the oxyfluoride compound formed in some of the crystal grains or in the part of the grain boundary has a difference in continuity thereof between a direction parallel to a direction of anisotropy and a direction perpendicular to the direction of anisotropy.

9. A rotating machine according to claim 8, wherein the layer of the fluoride compound or the layer of the oxyfluoride compound formed in some of the crystal grains or in the part of the gain boundary has a mean volume that is different between a direction parallel to a direction of anisotropy of the sintered magnet and a direction perpendicular to the direction of anisotropy of the sintered magnet.

10. A rotating machine according to claim 8, wherein the layer of the fluoride compound or the layer of the oxyfluoride compound has a difference in at least one of concentration and film thickness thereof between a direction parallel to a direction of anisotropy of the sintered magnet and a direction perpendicular to the direction of anisotropy of the sintered magnet.

11. A rotating machine according to claim 8, wherein a concentration of fluorine is higher than that of oxygen in the fluoride compound or the oxyfluoride compound formed on the outermost surface of the sintered magnet; and an interface between a main phase of the sintered magnet and the oxyfluoride compound has unevenness of 10 nm or larger and 10 μm or smaller.

12. A rotating machine according to claim 8, wherein oxides are formed near the grain boundary of the fluoride compound or the oxyfluoride compound formed on the outermost surface of the sintered magnet.

13. A rotating machine according to claim 8, wherein the sintered magnet is formed by impregnation of a solution that is transmissive to light into a low density compact with gaps, the transmissive solution including the fluoride compound, the oxyfluoride compound or the fluoride compound or oxyfluoride compound containing carbon.

14. A rotating machine according to claim 8, wherein the fluoride compound or oxyfluoride compound that are formed on the outermost surface of the sintered magnet has a mean crystal particle size larger than that of the fluoride compound or the oxyfluoride compound in the inside of the crystal particles.

* * * * *